US008167008B2

(12) United States Patent
Taniguchi et al.

(10) Patent No.: US 8,167,008 B2
(45) Date of Patent: May 1, 2012

(54) TABLET FILLING INSTRUMENT

(75) Inventors: Akira Taniguchi, Osaka (JP); Takafumi Imai, Osaka (JP); Yoshinori Maeji, Osaka (JP)

(73) Assignee: Yuyama Mfg. Co., Ltd. (JP)

( * ) Notice: Subject to any disclaimer, the term of this patent is extended or adjusted under 35 U.S.C. 154(b) by 717 days.

(21) Appl. No.: 12/227,914

(22) PCT Filed: Jun. 18, 2008

(86) PCT No.: PCT/JP2008/061158

§ 371 (c)(1),
(2), (4) Date: Dec. 2, 2008

(87) PCT Pub. No.: WO2008/156119

PCT Pub. Date: Dec. 24, 2008

(65) Prior Publication Data

US 2010/0230004 A1 Sep. 16, 2010

(30) Foreign Application Priority Data

Jun. 21, 2007 (JP) ..... 2007-164046
Jun. 11, 2008 (JP) ..... 2008-153228

(51) Int. Cl.
*B67C 3/26* (2006.01)

(52) U.S. Cl. ..... 141/281; 53/235; 141/283

(58) Field of Classification Search ..... 141/165, 141/468, 247, 281, 283; 53/235, 239, 242, 53/244, 247, 248, 249, 250, 475; 198/681; 221/222; 211/59.2, 74; 193/25 FT
See application file for complete search history.

(56) References Cited

U.S. PATENT DOCUMENTS

| | | | | | |
|---|---|---|---|---|---|
| 3,122,869 | A | * | 3/1964 | Miller et al. | 53/122 |
| 3,553,927 | A | * | 1/1971 | Anglade, Jr. | 53/448 |
| 3,601,952 | A | * | 8/1971 | Cato | 53/473 |
| 4,494,644 | A | * | 1/1985 | Rizzo, Sr. | 198/409 |
| 4,531,345 | A | * | 7/1985 | Nigrelli et al. | 53/534 |
| 5,456,297 | A | * | 10/1995 | Crossdale et al. | 141/83 |
| 5,491,959 | A | * | 2/1996 | Jenne | 53/534 |
| 5,706,957 | A | * | 1/1998 | Hardy | 211/59.2 |
| 6,119,737 | A | * | 9/2000 | Yuyama et al. | 141/104 |

(Continued)

FOREIGN PATENT DOCUMENTS

JP 59-20563 5/1984

(Continued)

OTHER PUBLICATIONS

International Search Report dated Jun. 18, 2008.

*Primary Examiner* — Timothy L Maust
*Assistant Examiner* — Ted Kalbach, Jr.
(74) *Attorney, Agent, or Firm* — Wood, Phillips, Katz, Clark & Mortimer

(57) ABSTRACT

A tablet filling instrument 1 for dispensing tablets into a vial 9 in accordance with prescription data and discharging the vial 9 filled with the tablets in an outlet 113 includes a pair of holding members 111 each provided with at least one slope extending from an upper end located within the instrument 1 to a lower end located in the outlet 113, the holding members 111 being designed to receive at the upper ends the vial 9 filled with the tablets and to allow the vial 9 to slide down under its own weight to the lower ends with supporting a flange 9*a* around an outer periphery of the vial 9.

10 Claims, 20 Drawing Sheets

U.S. PATENT DOCUMENTS

| | | | | |
|---|---|---|---|---|
| 6,457,611 | B1 * | 10/2002 | Koehler | 222/462 |
| 6,523,719 | B2 * | 2/2003 | Trulaske, Sr. | 221/301 |
| 6,581,355 | B1 * | 6/2003 | Yuyama et al. | 53/135.1 |
| 6,766,911 | B2 * | 7/2004 | Higgins | 211/59.2 |
| 6,920,905 | B2 * | 7/2005 | Maria | 141/168 |
| 7,228,198 | B2 * | 6/2007 | Vollm et al. | 700/235 |
| 7,289,879 | B2 * | 10/2007 | William et al. | 700/235 |
| 7,461,759 | B2 * | 12/2008 | Guerra | 221/93 |
| 7,549,266 | B2 * | 6/2009 | Yuyama et al. | 53/281 |
| 7,549,268 | B2 * | 6/2009 | Kim | 53/411 |
| 7,694,846 | B2 * | 4/2010 | Yuyama et al. | 221/162 |
| 7,721,508 | B2 * | 5/2010 | Yuyama et al. | 53/249 |
| 7,770,357 | B2 * | 8/2010 | Yuyama et al. | 53/167 |
| 7,845,144 | B2 * | 12/2010 | Yuyama | 53/249 |
| 7,942,172 | B1 * | 5/2011 | Cuellar | 141/238 |
| 2002/0007868 | A1 * | 1/2002 | Kodama et al. | 141/104 |
| 2007/0163133 | A1 * | 7/2007 | Yuyama et al. | 33/373 |
| 2007/0169437 | A1 * | 7/2007 | Yuyama et al. | 53/467 |
| 2007/0262084 | A1 * | 11/2007 | Yuyama et al. | 221/135 |
| 2010/0154928 | A1 * | 6/2010 | Taniguchi et al. | 141/311 R |
| 2010/0251667 | A1 * | 10/2010 | Yuyama et al. | 53/317 |
| 2011/0123306 | A1 * | 5/2011 | Imai et al. | 414/751.1 |
| 2011/0178634 | A1 * | 7/2011 | Yuyama et al. | 700/232 |

FOREIGN PATENT DOCUMENTS

| | | |
|---|---|---|
| JP | 2004-35001 | 2/2004 |
| JP | 2005-211537 | 8/2005 |

* cited by examiner

TABLET FILLING INSTRUMENT

TECHNICAL FIELD

The present invention relates to a tablet filling instrument for filling a vial with tablets.

BACKGROUND ART

In a tablet filling instrument which dispenses tablets into a vial in accordance with prescription data and discharges the vial filled with the tablets in an outlet, it is necessary to keep the vial waiting at the outlet until being taken out by an operator. That's why, conventionally, as described in the below-identified patent document 1 for example, there has been provided a plurality of outlets, at each of which a pair of holding members urged toward a direction approaching each other, so as to hold a barrel of a vial in the pair of holding members.

However, such a configuration as provided with a pair of holding members had had disadvantages such as the need for a longer distance to convey the vial filled with tablets to the holding members by a conveyer and for a higher manufacturing cost because of a complicated mechanism with an urging member for urging a pair of holding members.

Patent Document 1: JP 2005-211537 A

DISCLOSURE OF INVENTION

Problem to be Solved by the Invention

It is an object of the present invention to provide a tablet filling instrument capable of conveying a vial to an outlet and holding it in the outlet with a simpler structure and a lower cost.

Means to Solve the Problem

In order to solve the above-mentioned problems and drawbacks, the present invention provides a tablet filling instrument having an outlet, for dispensing tablets into a vial in accordance with prescription data and discharging the vial filled with the tablets in the outlet, the vial having a flange at its outer periphery, the instrument including a pair of holding members each provided with at least one slope extending from an upper end located within the instrument to a lower end located in the outlet, and the holding members being designed to receive at the upper ends of the slopes the vial filled with the tablets and to allow the vial to slide down under its own weight to the lower ends of the slopes with supporting the flange of the vial.

According to this configuration, when a vial having been filled with tablets is supplied to upper ends of slopes of a pair of holding members, the vial slides down the slopes under its own weight to lower ends located in an outlet and is held in the outlet. That eliminates the need for lengthening of a distance to convey vials by a conveying device and dispenses with an urging member for holding vials, thereby enabling manufacture of the instrument with a simpler structure and a lower cost.

Preferably, the slopes of the holding members are each formed by a side wall of a guide groove formed on a side of the holding member. According to this configuration, it is not necessary to attach a member having a slope, so that only forming of the guide groove at the side of the holding member readily forms a slope.

Preferably, the slopes of the holding members each have a flat face adjacent to the lower end and a step between the flat face and the lower end of the slope. According to this configuration, the vial having slid down the to slope moves downward spontaneously after sliding over the step, so that tablets would not spill from the opening of the vial even though the vial is filled with the tablets to capacity. In this case, it is preferable that the slopes of the holding members each have a convex face at upstream of the step. Thereby, the vial having slid down the slope slides over the convex face and further over the step, so as to have a larger force for moving downward. That allows the vial to stably stop.

Preferably, the slopes of the holding members each include at least one selected from a concave face and a convex face. According to this configuration, the flange of the vial sliding down the slope is in touch with the slope at two contacts in the case of the concave face and at one contact in the case of the convex face, so that the vial smoothly slides down the slope because of reduced sliding resistance. That reduces conveying time.

It is preferable that the vial has a protruding piece protruding outward from the flange and the slopes of the holding members each have a protruding portion, so that the protruding piece of the vial is turned toward upstream of the sliding direction by contacting with one of the protruding portions of the slopes while the vial is sliding down. According to this configuration, the vial is held in the outlet with the protruding piece, which is provided for locking a cap of the vial, facing a predetermined direction, so that a label applied around the vial is readily checked with eyes.

It is preferable that the holding members are each provided with a plurality of discrete slopes designed to support the flange of the vial of various sizes, the slope for a vial of small size being situated above the slope for a vial of large size. According to this configuration, it is possible to hold both vials of large size and of small size in one outlet.

In this case, the discrete slopes preferably have a gap between the upper ends of the slopes wider than a gap between the lower ends of the slopes. This configuration prevents the upper end of a lower slope from disturbing the vial in supplying the vial to the upper end of an upper slope since the gap between the upper ends of the discrete slopes is wide.

It is preferable that the discrete slopes each have a guiding member extending obliquely upward at its upper end, the guiding member having a top face continuous with the slope. According to this configuration, it is possible to further extend the slopes and to prevent a conveying unit for conveying and supplying vials to the holding members from disturbing the holding members.

Advantageous Effect of the Invention

The present invention eliminates the need for lengthening of a distance to convey vials by a conveying device and dispenses with an urging member for holding vials, thereby enabling manufacture of the tablet filling instrument with a simpler structure and a lower cost, since the instrument includes the pair of holding members each provided with at least one slope extending from the upper end located within the instrument to the lower end located in the outlet, and the holding members are designed to receive at the upper ends the vial filled with the tablets and to allow the vial to slide down under its own weight to the lower ends with supporting the flange around the to outer periphery of the vial.

BEST MODE FOR CARRYING OUT THE INVENTION

Figure 1:
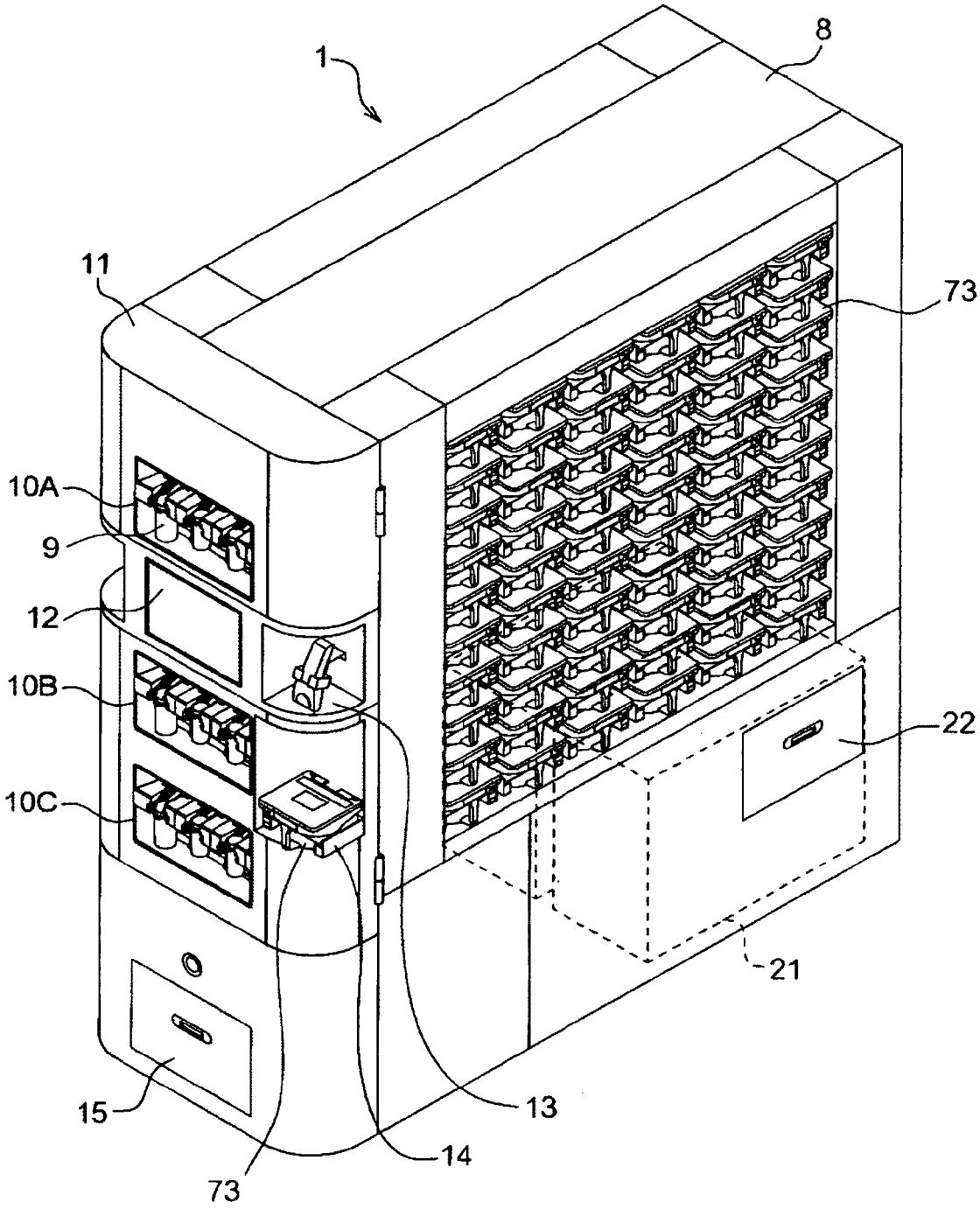
FIG. 1 is a perspective view of a tablet filling instrument of the present invention.
Figure 2:
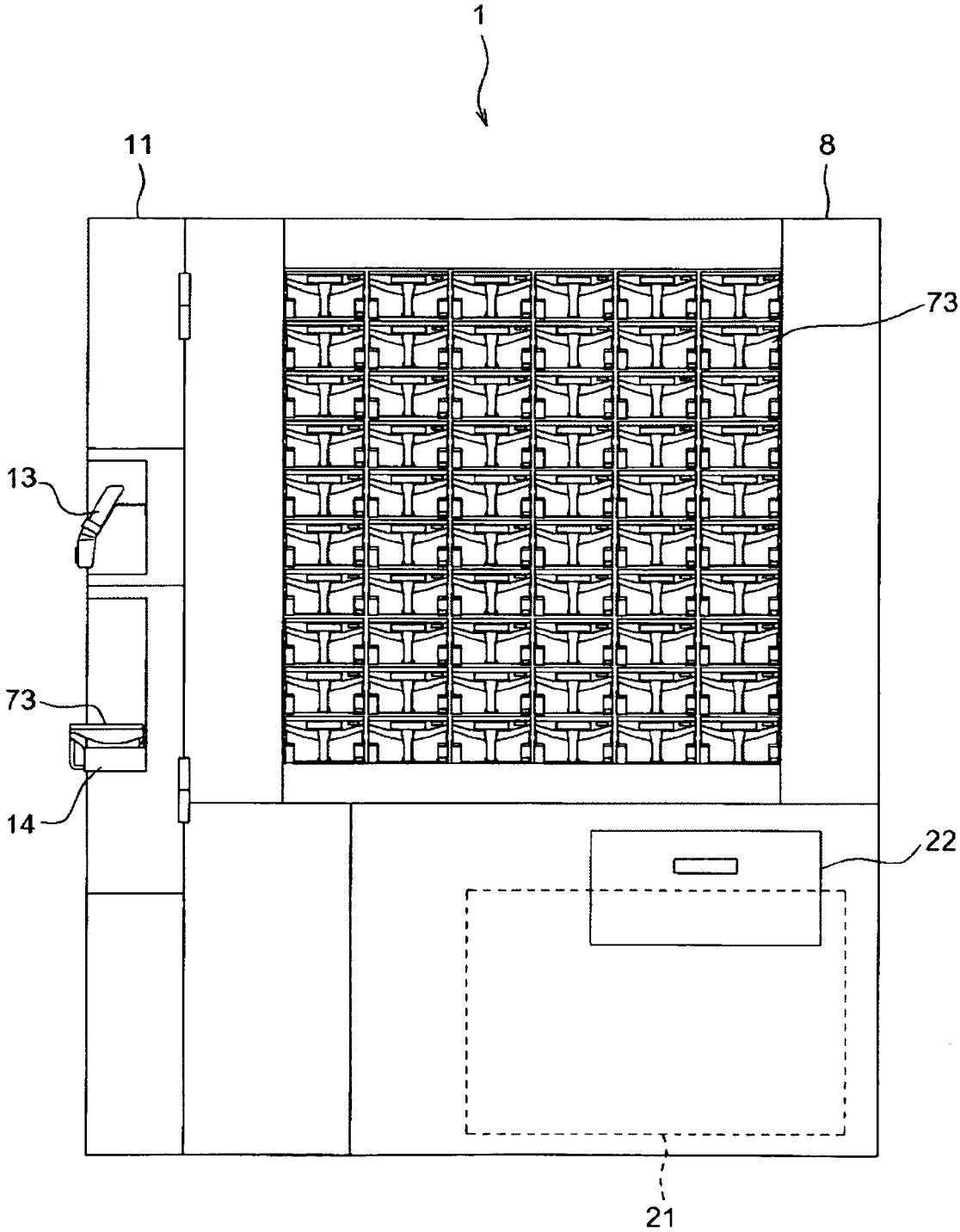
FIG. 2 is a side view of the tablet filling instrument in FIG. 1.
Figure 3:
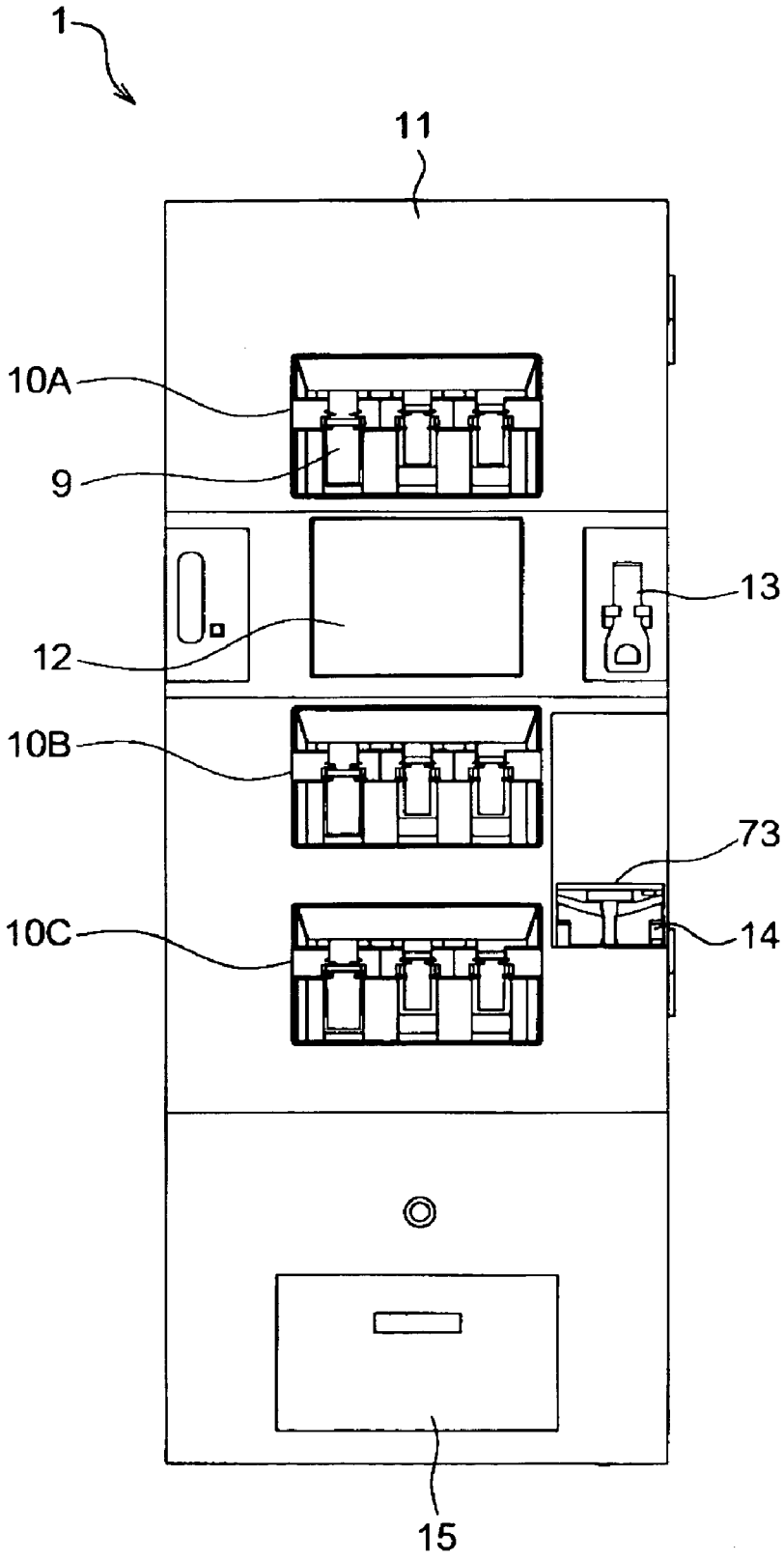
FIG. 3 is a front view of the tablet filling instrument in FIG. 1.
Figure 4:
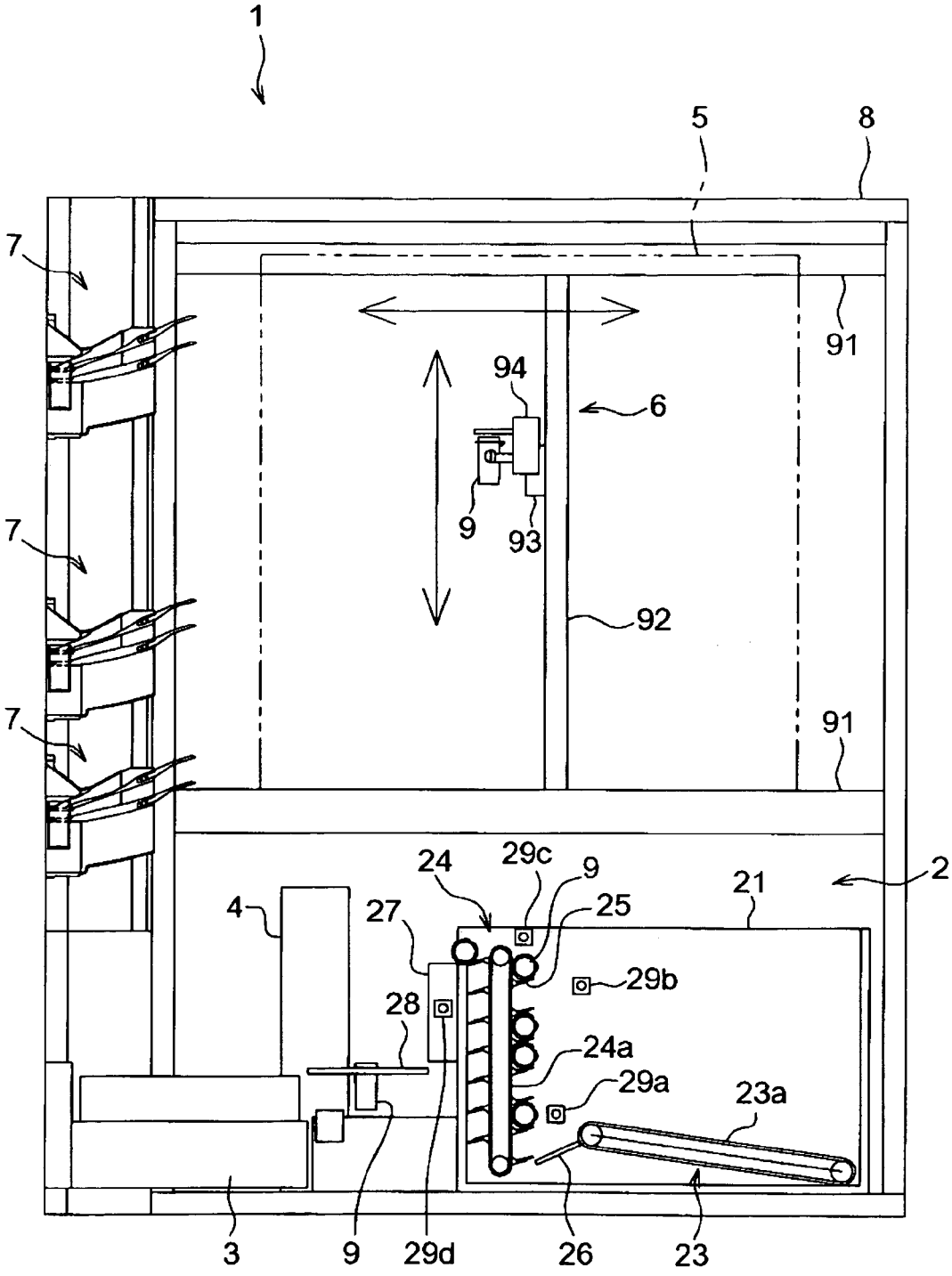
FIG. 4 is a side cross section of the tablet filling instrument in FIG. 1.

FIGS. 1 to 4 show a tablet filling instrument 1 that is an embodiment of the present invention. As shown in FIG. 4, the instrument 1 includes a vial supply unit 2, a labeling unit 3, a vial lifter 4, a tablet supply unit 5, a conveying unit 6, and a discharging unit 7. Herein, the instrument 1 has a main body 8, in which a face provided with discharging windows 10A, 10B and 10C for vials 9 is designated as a front.

The front of the main body 8 has a front door 11 being openable and closable. The front door 11 has an operation panel 12 between the upper discharging window 10A and the middle discharging window 10B besides the three discharging windows 10A, 10B and 10C opening and juxtaposed vertically. There is provided a barcode reader 13 on the right side of the operation panel 12 and an auxiliary mounting table 14 for filling or returning of tablets below the reader 13. There is provided a drawer for pulling out the labeling unit 3 below the lower discharging window 10C.

<Vial Supply Unit 2>

Figure 5:
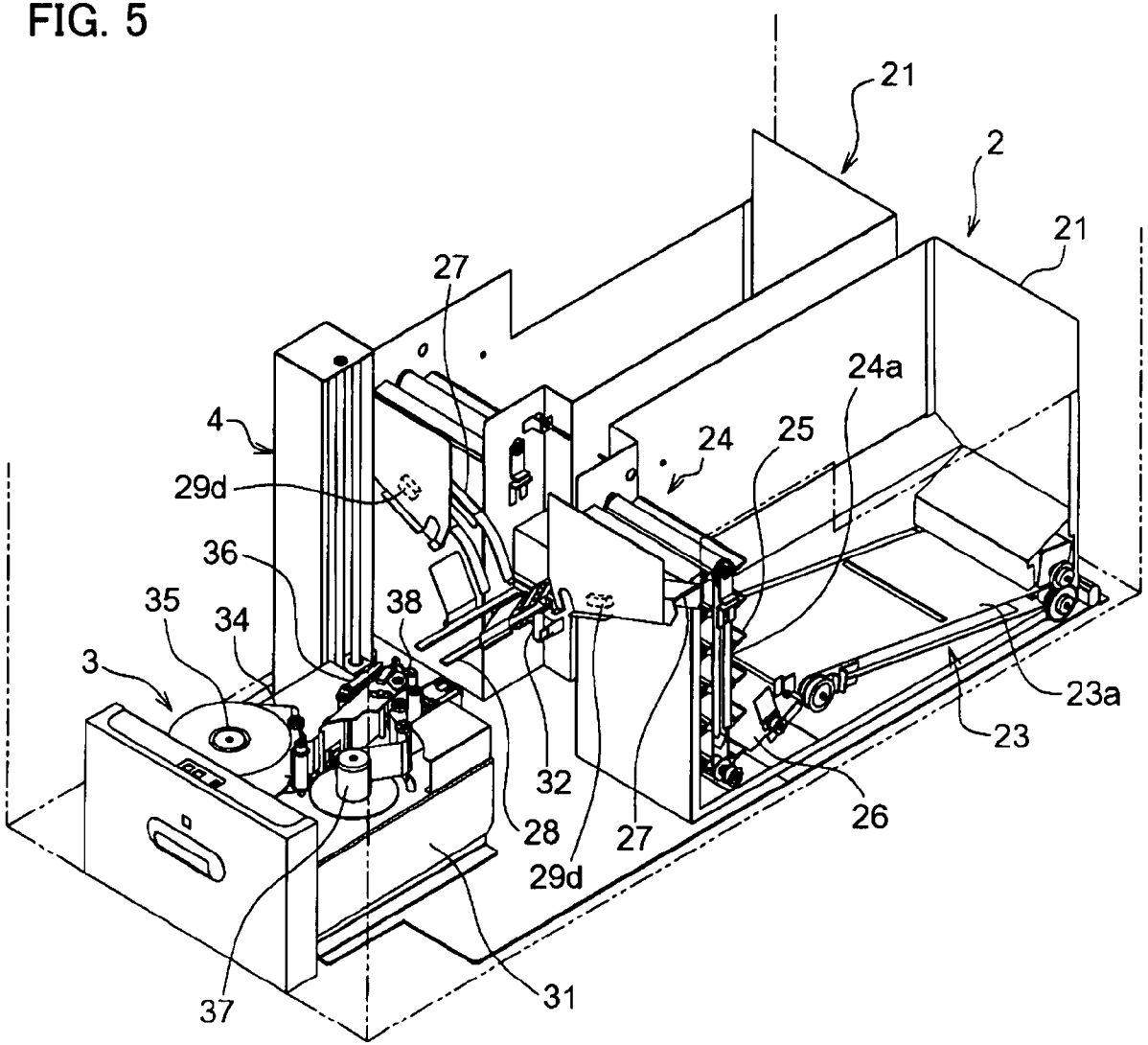
FIG. 5 is a perspective view of a vial supply unit, a labeling unit, and a vial lifter.

As shown in FIG. 5, the vial supply unit 2 has a pair of stockers 21 of a rectangular box shape disposed on both sides at the bottom of the back thereof as viewed from the front of the main body 8. Each stocker 21 randomly stocks vials 9 of various sizes. Vials 9 are to be refilled by opening doors 22 (see FIG. 1) disposed on the right and left sides of the main body 8. Each stocker 21 has on its inside bottom a conveyer 23 composed of an endless belt 23*a* slanting upward toward the front of the main body 8 and capable of being driven to run. The conveyer 23 is designed to convey vials 9 stocked in the stocker 21 toward the front side. Each stocker 21 further has a take-out device 24 disposed vertically along the inner wall of the front of the stocker 21. The take-out device 24 is composed of an endless belt 24*a* capable of being driven to run, to which paddles 25 are attached at regular intervals. A vial 9 is held horizontally by each paddle 25 to be taken out in accordance with ascent of the endless belt 24*a*. There is provided a guide plate 26 between the front end of the conveyer 23 and the lower end of the take-out device 24, for guiding vials 9 having been conveyed by the conveyer 23 to the paddles 25 of the take-out device 24.

Figure 6:
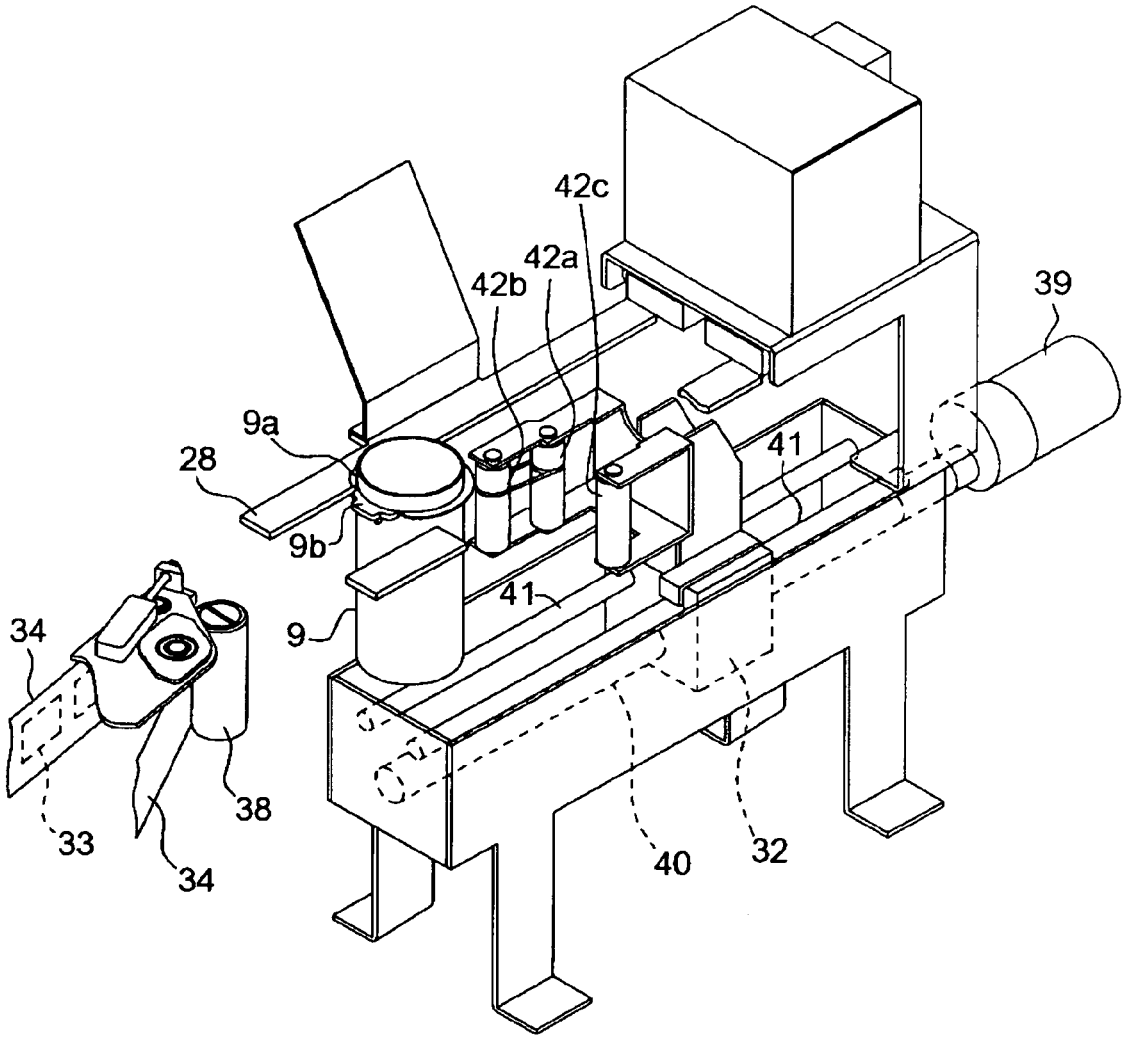
FIG. 6 is a perspective view of the labeling unit.

The stockers 21 have on the outer walls of the front sides a pair of chutes 27 for sliding vials 9 having been taken out from the stockers 21 by means of the take-out devices 24 and a pair of forks 28 for receiving and holding the vials 9 having been slid from the pair of chutes 27. The forks 28 have horizontally variable-width so as to hold any of vials 9 of various sizes by means of the known mechanism such as a rack-and-pinion mechanism. Herein, vials 9 each, as shown in FIG. 6, have a flange 9*a* around an outer periphery of its opening and a protruding piece 9*b* having a mechanism of locking a cap not shown.

The vial supply unit 2, as shown in FIG. 4, has four sensors inside each of the stockers 21: a stockout sensor 29*a* at its lower part; an overfill sensor 29*b* at its upper part; a preparatory state detection sensor 29*c* for detecting a vial 9 held by the paddle 25 in the topmost position; and a vial waiting sensor 29*d* for detecting a vial 9 having been stopped on the chute 27 by a stopper not shown.

<Labeling Unit 3>

As shown in FIG. 5, the labeling unit 3 mainly consists of a label printer 31 and a pusher 32. The label printer 31, as shown in FIG. 6, uses a label tape 34, on which labels 33 to be applied around vials 9 are applied at regular intervals. The label printer 31, as shown in FIG. 5, is the known one, which includes (1) a tape reel 35 around which the label tape 34 is wound, (2) a print head 36 for printing information such as a prescription number, a patient's name, and a drug name on each label 33 of the label tape 36 supplied from the tape reel 35, (3) a take-up reel 37 for taking up the label tape 34 from which the label 33 has been removed, and (4) a driving roller 38 for rotating vials 9. The pusher 32 is, as shown in FIG. 6, movable along a guide rod 41 and parallel to the forks 28 by means of a ball screw 40 driven by a motor 39. The pusher 32 has three rollers 42*a*, 42*b* and 42*c*, by which a vial 9 held by the forks 28 of the vial supply unit 2 is pressed against the driving roller 38 of the label printer 31. The main body 32, as shown in FIG. 8, has a sensor 43 for detecting a position of the protruding piece 9*b* of a vial 9 of a large or small size.

<Vial Lifter 4>

Figure 8:
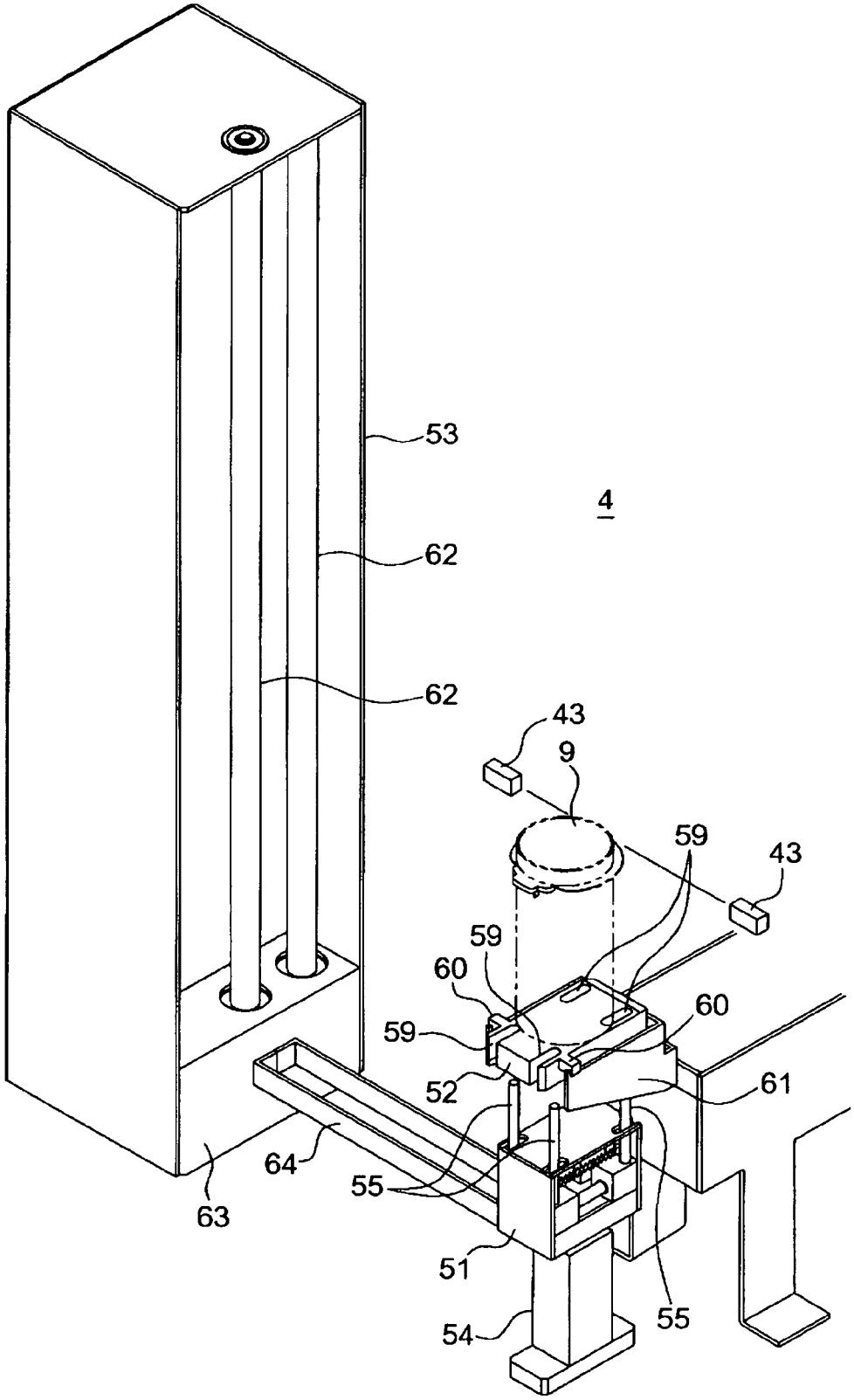
FIG. 8 is a perspective view of the vial lifter in which a lifting table is in a wait status.
Figure 9:
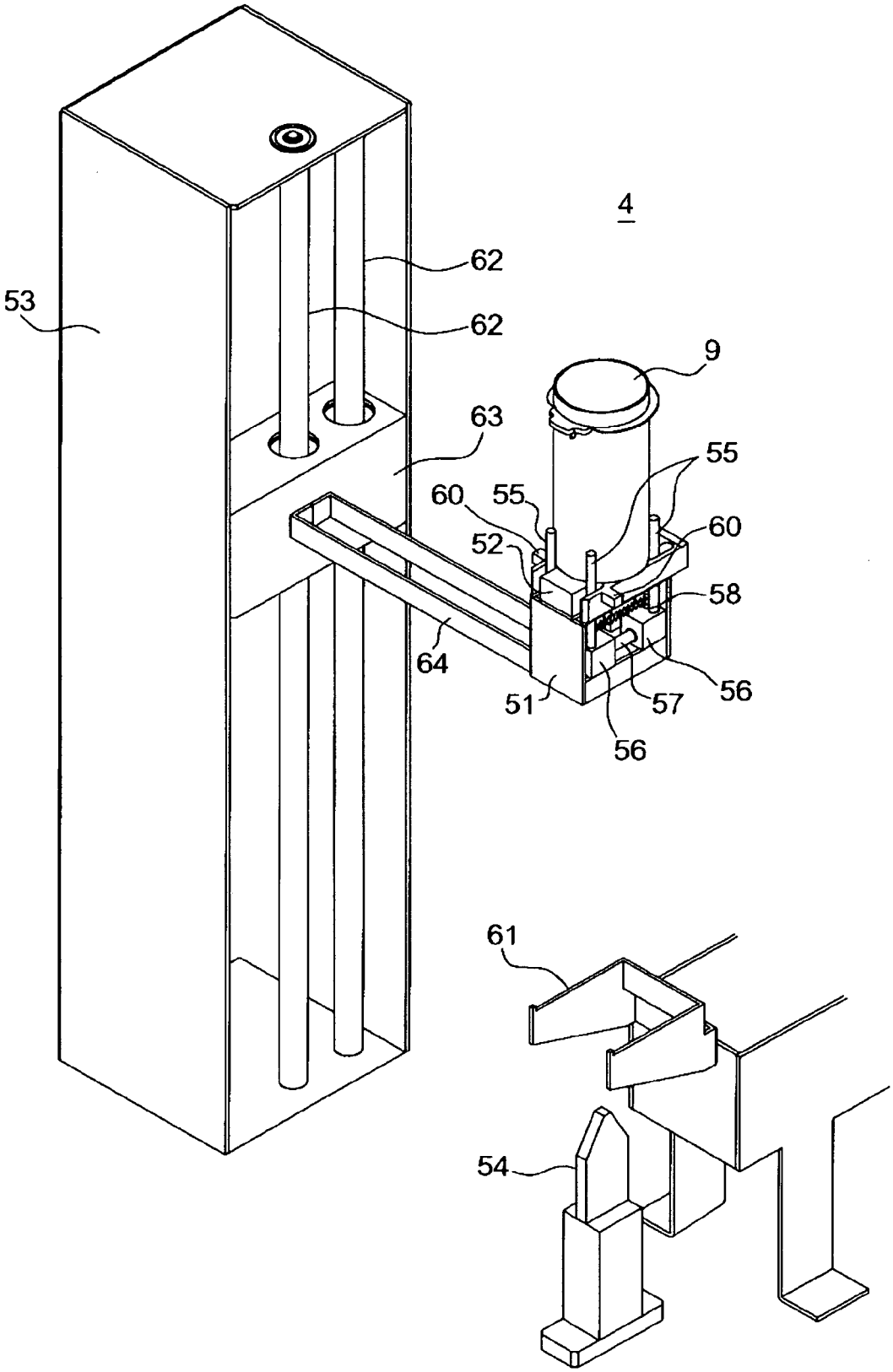
FIG. 9 is a perspective view of the vial lifter in which the lifting table is moving up.
Figure 10A:
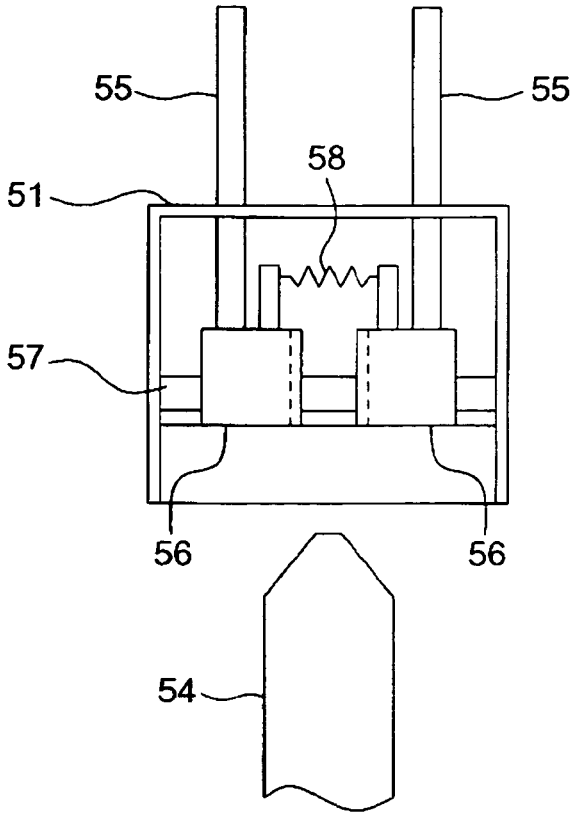
FIGS. 10A and 10B are side views showing operations of movable blocks of pins and a bar for opening and closing pins.
Figure 10B:
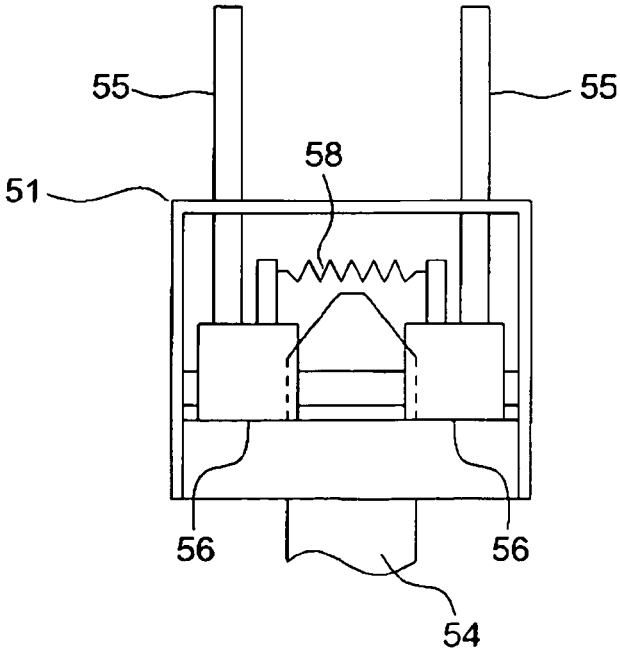
Figure 11:
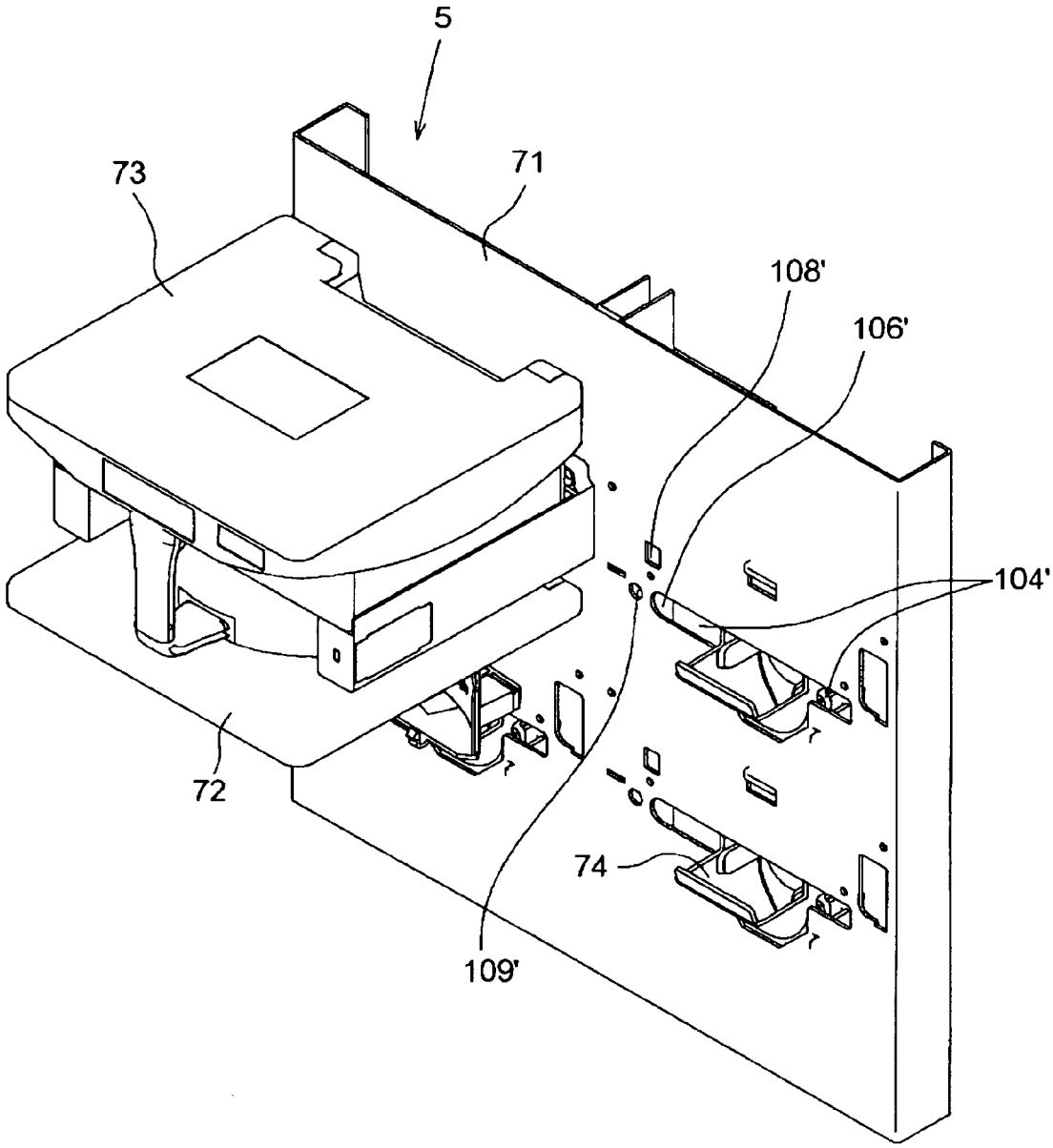
FIG. 11 is a perspective view of a tablet supply unit.

As shown in FIGS. 8 and 9, the vial lifter 4 mainly consists of a lifting table 51 on which a vial 9 is placed, a holding plate 52 mounted on the lifting table 51, a lifting mechanism 53 for lifting and lowering the lifting table 51 and the holding plate 52, and a bar 54 for opening and closing pins.

The lifting table 51 has on its top face four pins 55 sticking up and for holding an outer periphery of a vial 9. There is provided two movable blocks 56, to each block 56 bases of a pair of the opposed pins 55 are fixed. The two movable blocks 56 are movable in directions toward and away from each other along guide rods 57 and are urged in a direction toward each other by springs 58. The holding plate 52 has elongated cutouts 59 in which the four pins 55 are inserted. The holding plate 52 has at its outer periphery a plurality of lugs 60 and is designed to be put on a bracket 61 fixed to the main body 8 with the lugs 60. The lifting mechanism 53 has a lifting block 63 lifting and lowering along guide rods 62 by means of a belt driving device not shown, the lifting block 63 having an arm 64 so as to fix the lifting table 51 to a distal end of the arm 64. The bar 54 for opening and closing pins is located below the lifting table 51 and is fixed to the main body 8. The bar 54 is engaged with and disengaged from a space between the two movable blocks 56 of the lifting table 51 in accordance with lifting and lowering movements of the lifting table 51 so as to move the movable blocks 56 to open and close the four pins 55.

When the lifting plate 51 is lowered by driving of the lifting mechanism 53 of the vial lifter 4, as shown in FIG. 8, the four pins 55 are extended by the bar 54 located below the lifting table 51 and each move in a direction away from the vial 9 against the urging force of the springs 58. The holding plate 52 stops on the way down of the lifting table 51 by being hung up by the bracket 61, meanwhile the lifting table 51 continues down to the bottommost position. When the lifting table 51 moves up from the bottommost position, as shown in FIG. 9, the holding plate 52 hung up by the bracket 61 is placed on the table 51. Meanwhile, the four pins 55 are disengaged from the bar 54, thereby pressing and holding the vial 9 placed on the holding plate 52 by the urging force of the springs 58. The lifting mechanism 53 conveys the vial 9 placed on the lifting table 51 from a labeling position to a delivery position of the conveying unit 6 described below.

<Tablet Supply Unit 5>

Figure 12:
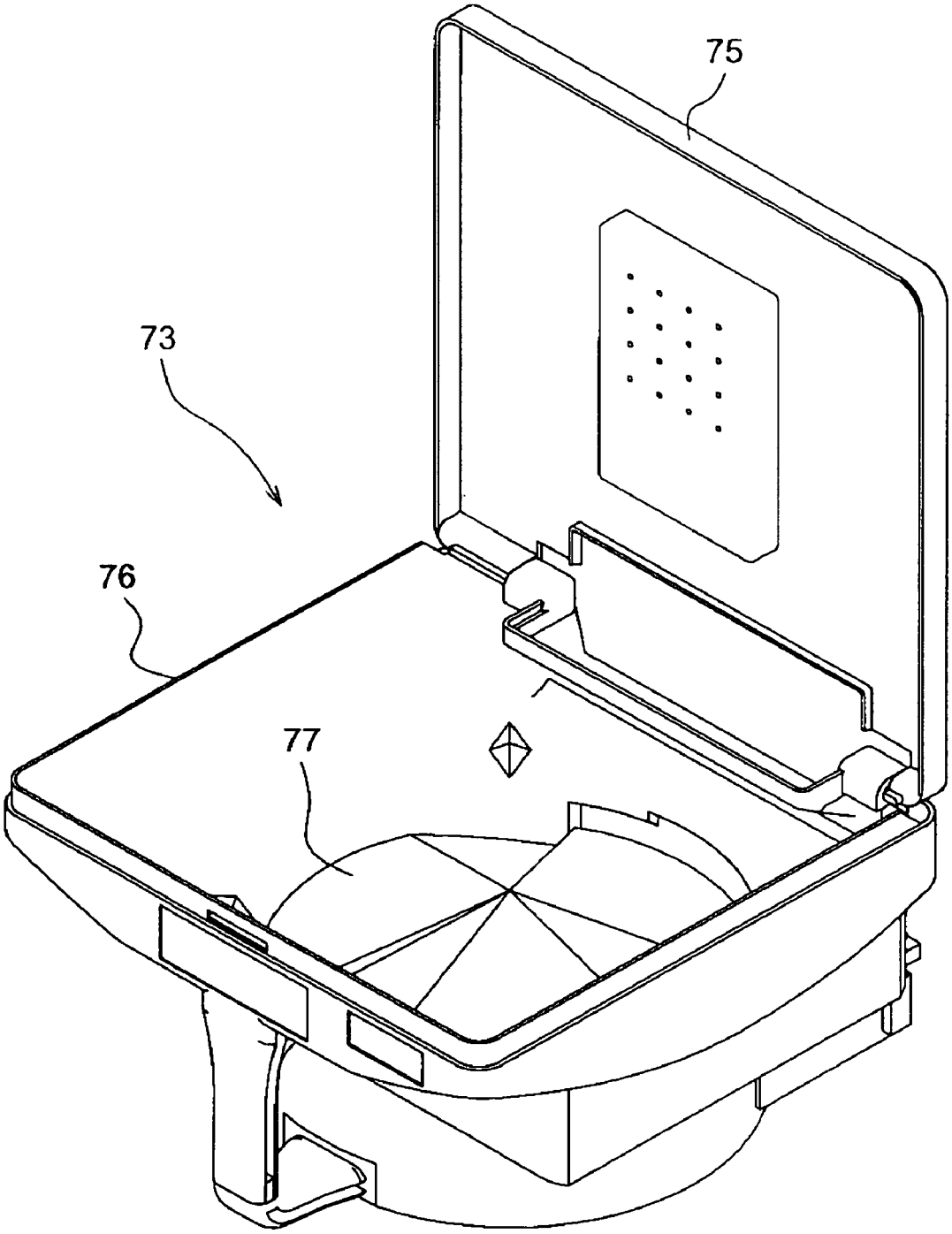
FIG. 12 is a perspective view of a tablet cassette viewed from above.
Figure 13:
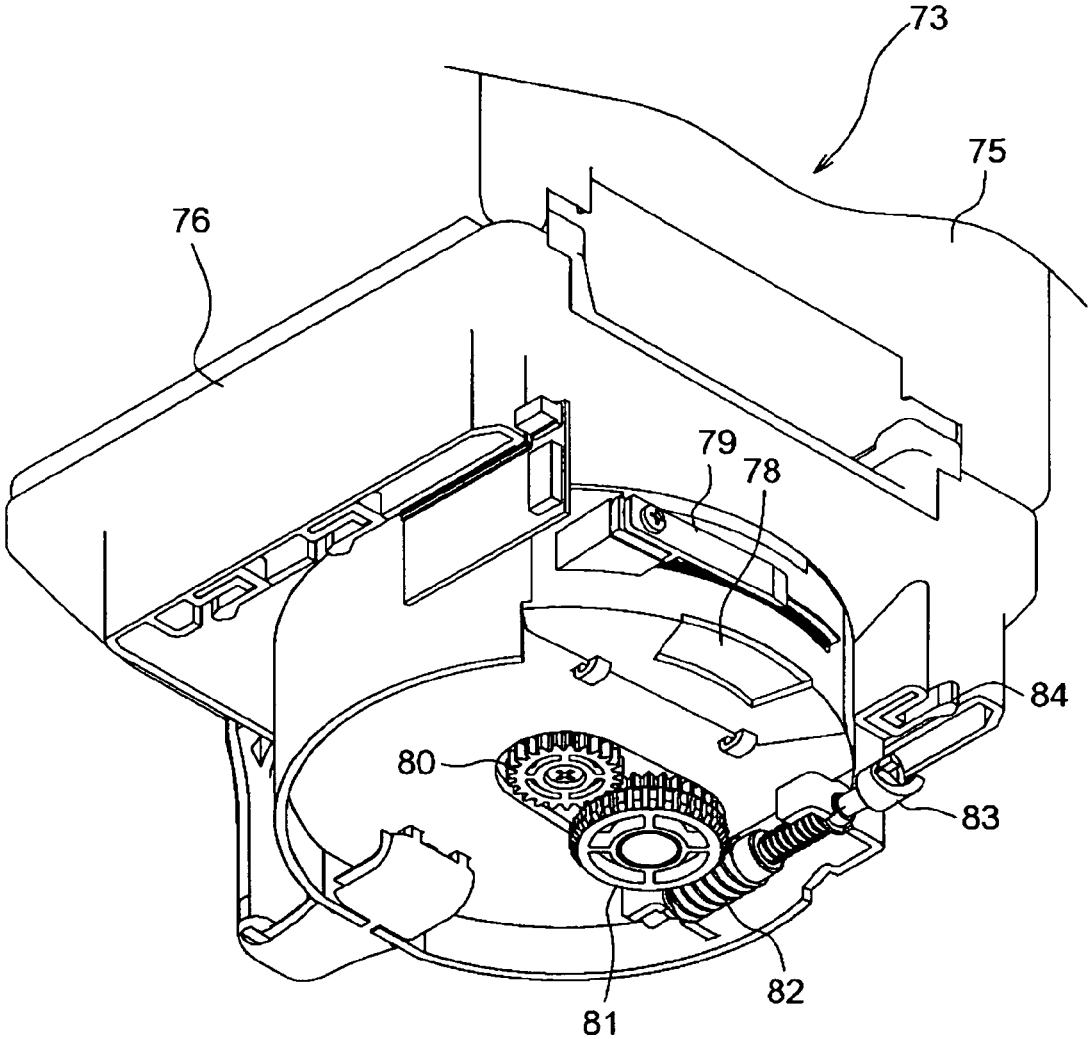
FIG. 13 is a perspective view of the tablet cassette viewed from below.

The tablet supply unit 5 includes supporting panels 71 at both sides of the main body 8, attaching boards 72 disposed on the panels 71, and a number of tablet cassettes 73 detachably attached on the boards 72. Each supporting panel 71 has tablet outlets 74 formed at positions corresponding to the tablet cassettes 73 respectively, and further has sensor holes 104', driving shaft holes 106', protruding piece holes 108', and detection rod holes 109' in which count sensors 104, driving shafts 106, protruding pieces 108, and detecting rods 109 of an arm unit 94 described below are put respectively. Each tablet cassette 73, as shown in FIG. 12, mainly consists of a tablet container 76 with a lid 75 attached thereto openably and closably and a rotor 77 attached rotatively to the inner bottom of the container 76. The rotor 77 has pockets (not shown) for holding tablets at its outer periphery, which extend in an axial direction and are juxtaposed at regular intervals in a peripheral direction. The tablet container 76, as shown in FIG. 13, has an outlet 78 formed at its outside bottom and communicating with one of the pockets of the rotor 77. There is provided a partition 79 attached above the outlet 78, for partitioning the pocket of the rotor 77 and for discharging a bottommost tablet among tablets held in the pocket through the outlet 78. The tablet container 76 has in the center of its outside bottom a rotor gear 80 is fixed to a rotating shaft of the rotor 77 penetrating the bottom of the container 76. The tablet container 76 further has an intermediate gear 81 engaging with the rotor gear 80 and a worm gear 82 engaging with the intermediate gear 81, both attached to its outside bottom. The worm gear 82 has an engaging receptacle 83 formed at its end and engaging with an engaging portion 107 of the driving shaft 106 of the conveying unit 6 described below to receive power. The tablet container 76 further has at its back side an engaging portion 84 formed adjacent to the engaging receptacle 83.

<Conveying Unit 6>

As shown in FIG. 4, the conveying unit 6 is disposed between the tablet supply units 5 at both sides of the main body 8 and includes first horizontal rails 91 fixed to the top and bottom of the main body 8, a vertical rail 92 mounted on the first horizontal rails 91 movably in an anteroposterior direction, a second horizontal rail 93 mounted on the vertical rail 92 movably in a vertically direction, and the arm unit 94 mounted on the second horizontal rail 93 movably in a lateral direction.

Figure 14:
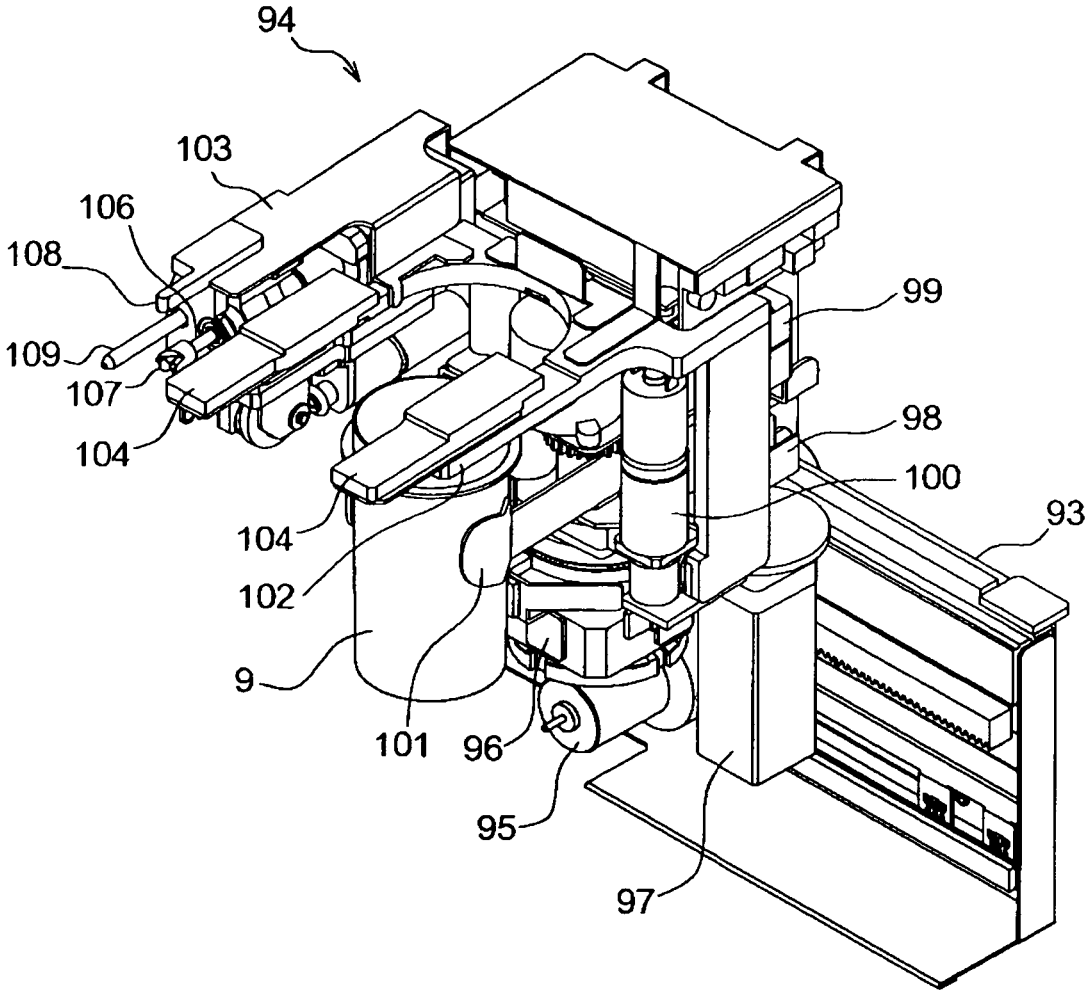
FIG. 14 is a perspective view of an arm unit of a conveying unit.
Figure 15:
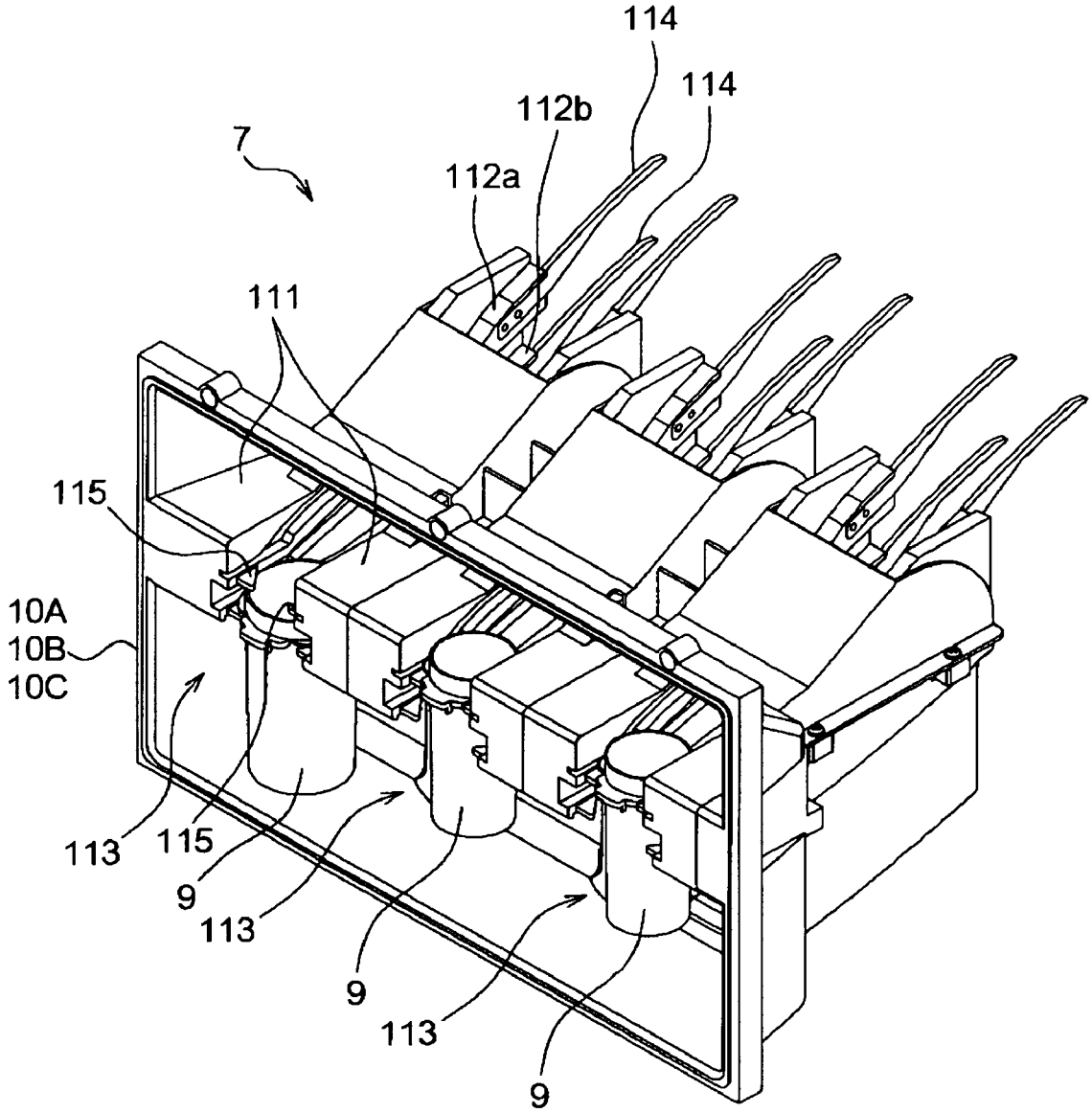
FIG. 15 is a perspective view of a discharging unit.

The arm unit 94, as shown in FIG. 14, mainly consists of (1) an orthogonal moving base 96 mounted on the second horizontal rail 93 so as to be moved by a motor 95, (2) a pivoting base 98 mounted on the orthogonal moving base 96 so as to be pivoted by a motor 97, and (3) a tilting base 99 mounted on the pivoting base 98 so as to be tilted by a motor not shown. The tilting base 99 is provided with a pair of arms 101 openable and closable by driving of a motor 100 so as to hold and release a vial 9. The pivoting base 98 is provided with a U-shaped sensor arm 102 and a driving arm 103 above the arms 101. The count sensors 104 are attached to both ends of the U-shape of the sensor arm 102 so as to count the number of tablets discharged from the tablet cassette 73. The driving arm 103 is provided with the driving shaft 106 rotating by being driven by the motor 105. The driving shaft 106 has at its end the engaging portion 107 engaging with the engaging receptacle 83 of the worm gear 82 of the above-mentioned tablet cassette 73. The driving arm 103 is further provided with the protruding piece 108 and the detection rod 109, the piece 108 positioning the arm unit 94 in the right place by engaging with the engaging portion 84 of the tablet cassette 73, and the rod 109 detecting whether the arm unit 94 is located in the right place.

<Discharging Unit 7>

The discharging unit 7 mainly consists of nine pairs of holding members 111, each three pairs of holding members 111 being disposed at each of the discharging windows 10A, 10B and 10C. The opposite sides of one pair of holding members 111 are each provided with two slopes 112*a* and 112*b* juxtaposed vertically, whose upper ends are located within the main body 8 and whose lower ends are located in any of the discharging windows 10A, 10B and 10C and form an outlet 113. A guiding member 114 extending obliquely upward is attached to the upper end of each of the slopes 112*a* and 112*b*. The guiding member 114 has a top face forming a slope continuous with the slope of the holding member 111. The slopes 112*a* and 112*b* have stoppers 115 attached to their lower ends respectively. The stoppers 115 normally project in a direction facing to each other by an urging force of a spring not shown, so as to catch a vial 9 having slid down the slopes 112*a* and 112*b*, while the stoppers 115 are withdrawn against the urging force of the spring when an operator takes out the vial 9, allowing the vial 9 to pass therethrough.

Figure 16:
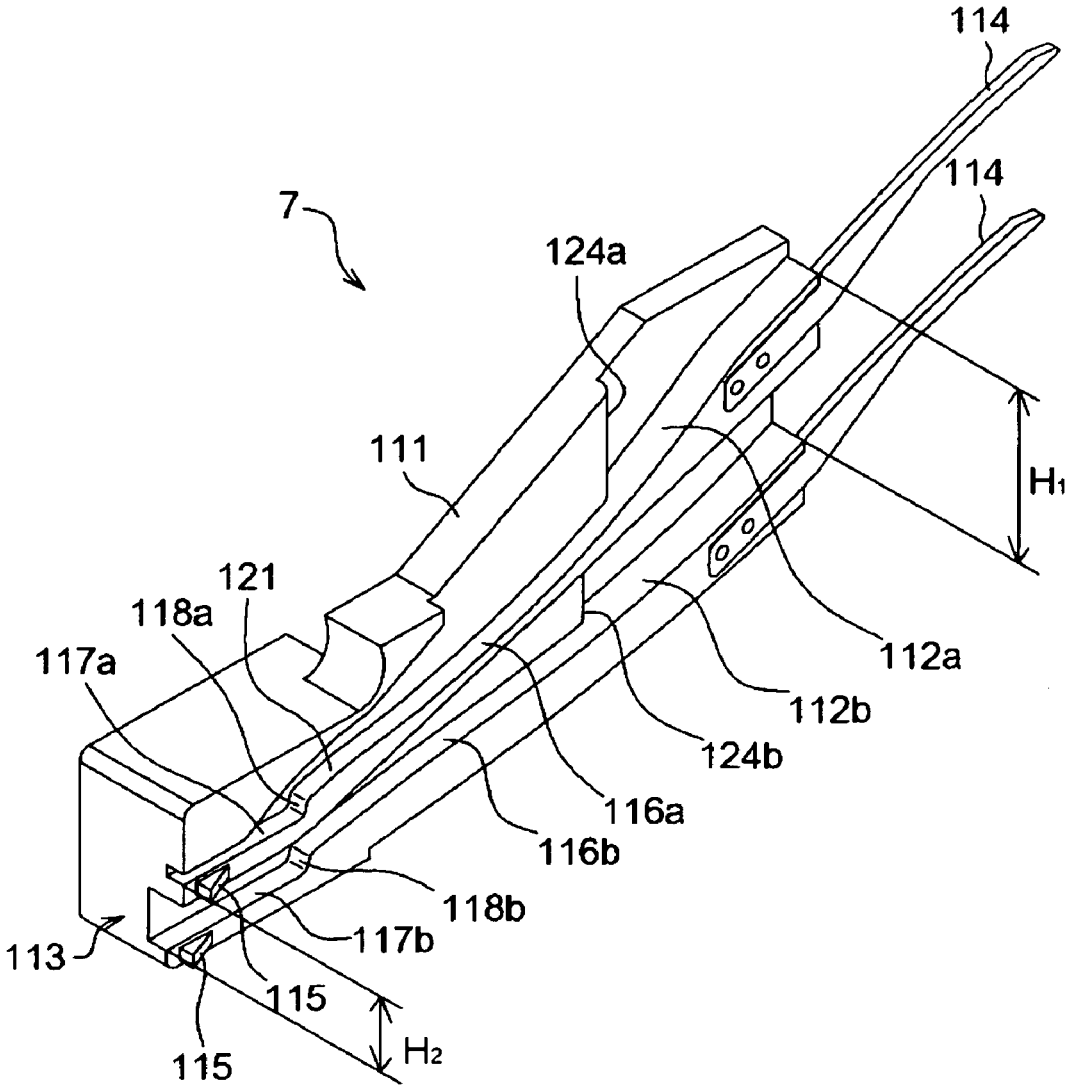
FIG. 16 is a perspective view of a holding member of the discharging unit.
Figure 17A:
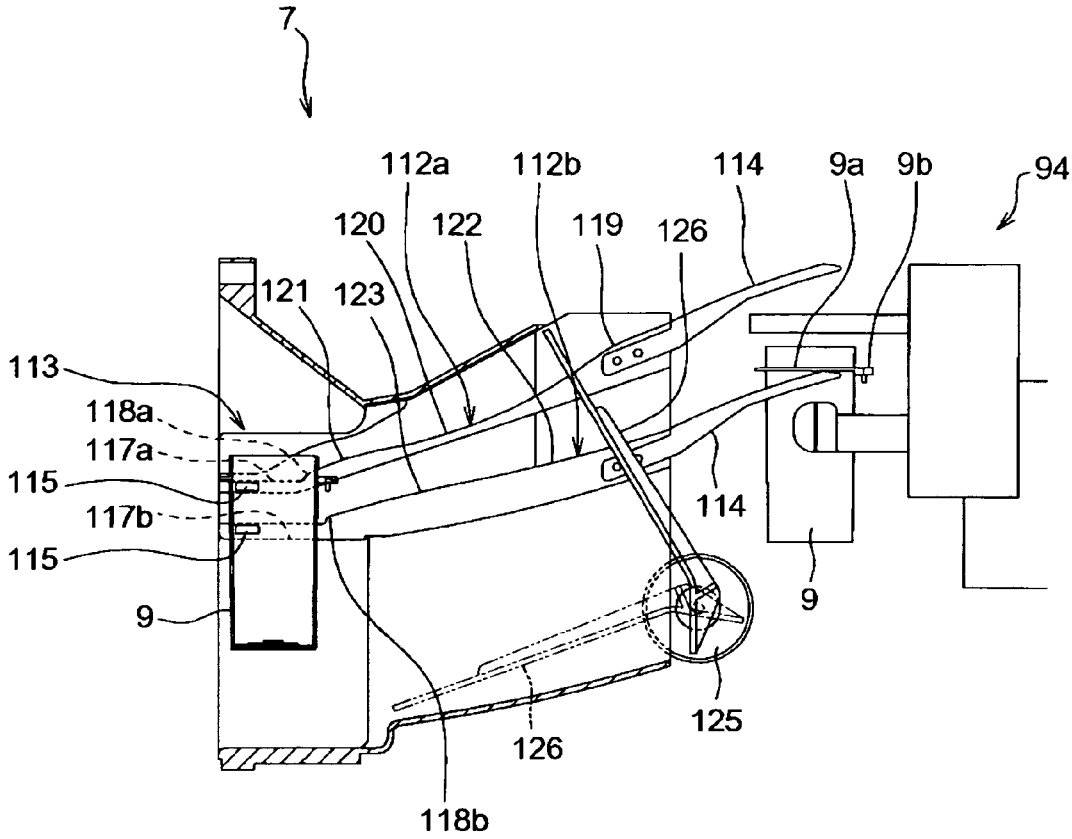
FIGS. 17A and 17B are side views showing operations to supply a vial to the discharging unit.

The discharging unit 7 will be described in detail below, making reference to FIGS. 16 and 17A. One pair of holding members 111 have side faces facing each other, each having two guide grooves 116*a* and 116*b*, whose bottom faces form the slopes 112*a* and 112*b* respectively. The guide grooves 116*a* and 116*b* are each formed so that a flange 9*a* of a vial 9 passes therethrough. The upper pair of slopes 112*a* and 112*a* is formed to have narrow horizontal gap therebetween so that a flange 9*a* of a vial 9 of small size is held and slides down. On the other hand, the lower pair of slopes 112*b* and 112*b* is formed to have large horizontal gap therebetween so that a flange 9*a* of a vial 9 of large size is held and slides down.

In each side face, the upper end of the slope 112*a* and the upper end of the slope 112*b* form a vertical gap $H_1$, while the lower end of the slope 112*a* and the lower end of the slope 112*b* form a vertical gap $H_2$, the gap $H_1$ being larger than the gap $H_2$. In other words, the upper slope 112*a* has an inclination sharper than the lower slope 112*b*. Flat faces 117*a* and 117*b* are formed adjacent to the lower ends of the slopes 112*a* and 112*b* respectively. There are provided steps 118*a* and 118*b* between the flat faces 117*a* and 117*b* and the lower ends of the slopes 112*a* and 112*b* respectively. The upper slope 112*a* includes a convex face 119, a concave face 120, and a convex face 121 again immediately before the step 118*a*, which are formed continuously in order from its upper side. Similarly, the lower slope 112*b* includes a concave face 122 and a convex face 123 both gentler than the faces of the upper slope 112*a* continuously in order from its upper side. The side faces facing to the slopes 112*a* and 112*b* of the guide grooves 116*a* and 116*b* are cut at upstream portion to form protruding portions 124*a* and 124*b* respectively. By this configuration, a protruding piece 9*b* of a vial 9 while sliding down the slope 112*a* or 112*b* is brought into contact with the protruding portion 124*a* or 124*b*, so as to face upstream of the sliding direction. Consequently, the vial 9 is to be discharged in the outlet 113 usually with the protruding piece 9*b* situated in the back position.

Further, at the rear end of the discharging unit 7, there is provided a door 126 being pivotable by a rotary solenoid 125 so as to open and close a back portion of each outlet 113. The door 126 normally closes the outlet 113 so that a user cannot insert his or her hand thereinto. When a vial 9 is discharged, the rotary solenoid 125 drives, as shown by two-dot chain lines in FIG. 17A, to open the door 126, so that the vial 9 slides down the slope 112*a* or 112*b*.

Figure 21:
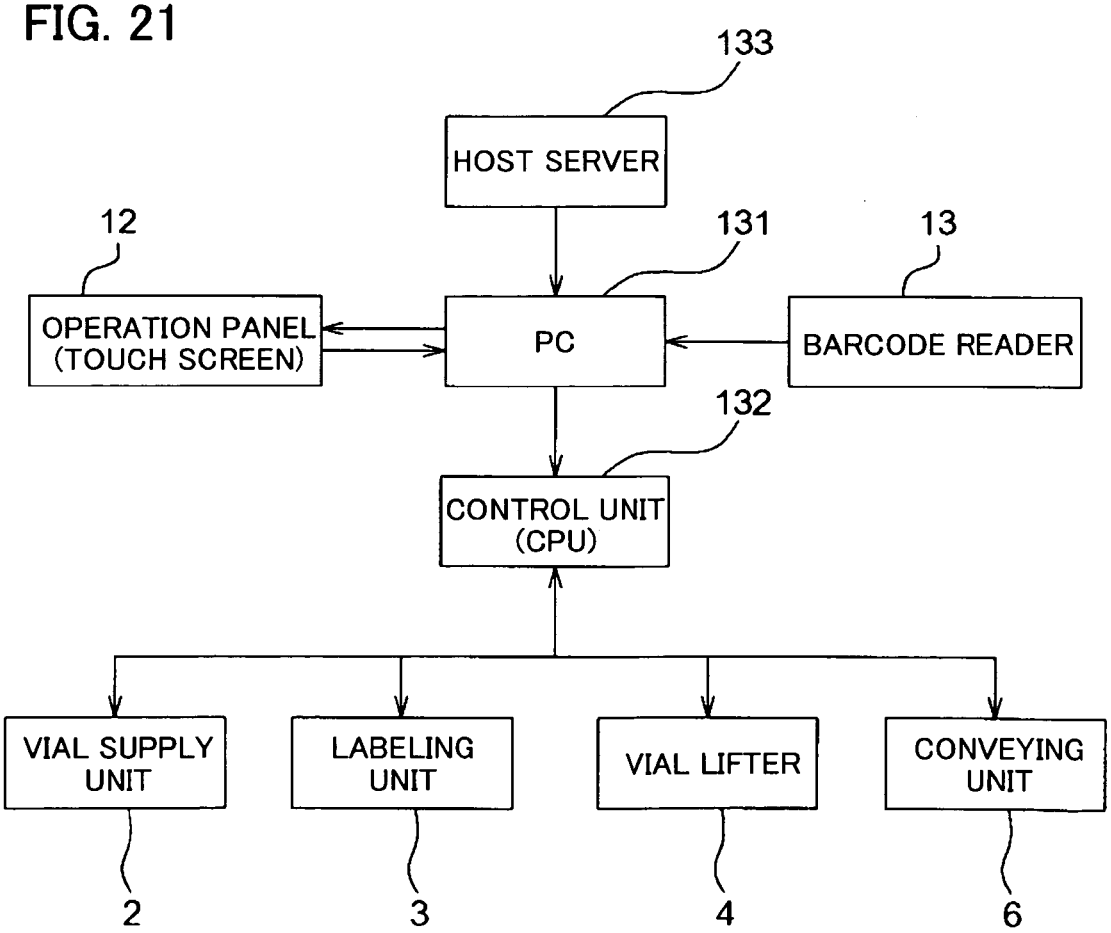
FIG. 21 is a block diagram of the tablet filling instrument.

FIG. 21 is a control block diagram of the tablet filling instrument 1 of the present invention. The vial supply unit 2, the labeling unit 3, the vial lifter 4, and the conveying unit 5 are controlled by a controlling unit 132 based on commands from a personal computer (PC) 131. The personal computer 131 is managed by a host server 133. The personal computer 131 receives signals inputted from a touch screen on the operation panel 12 and outputs display signals required for the operation panel 12. The personal computer 131 further receives read signals inputted from the barcode reader 13.

Figure 22:
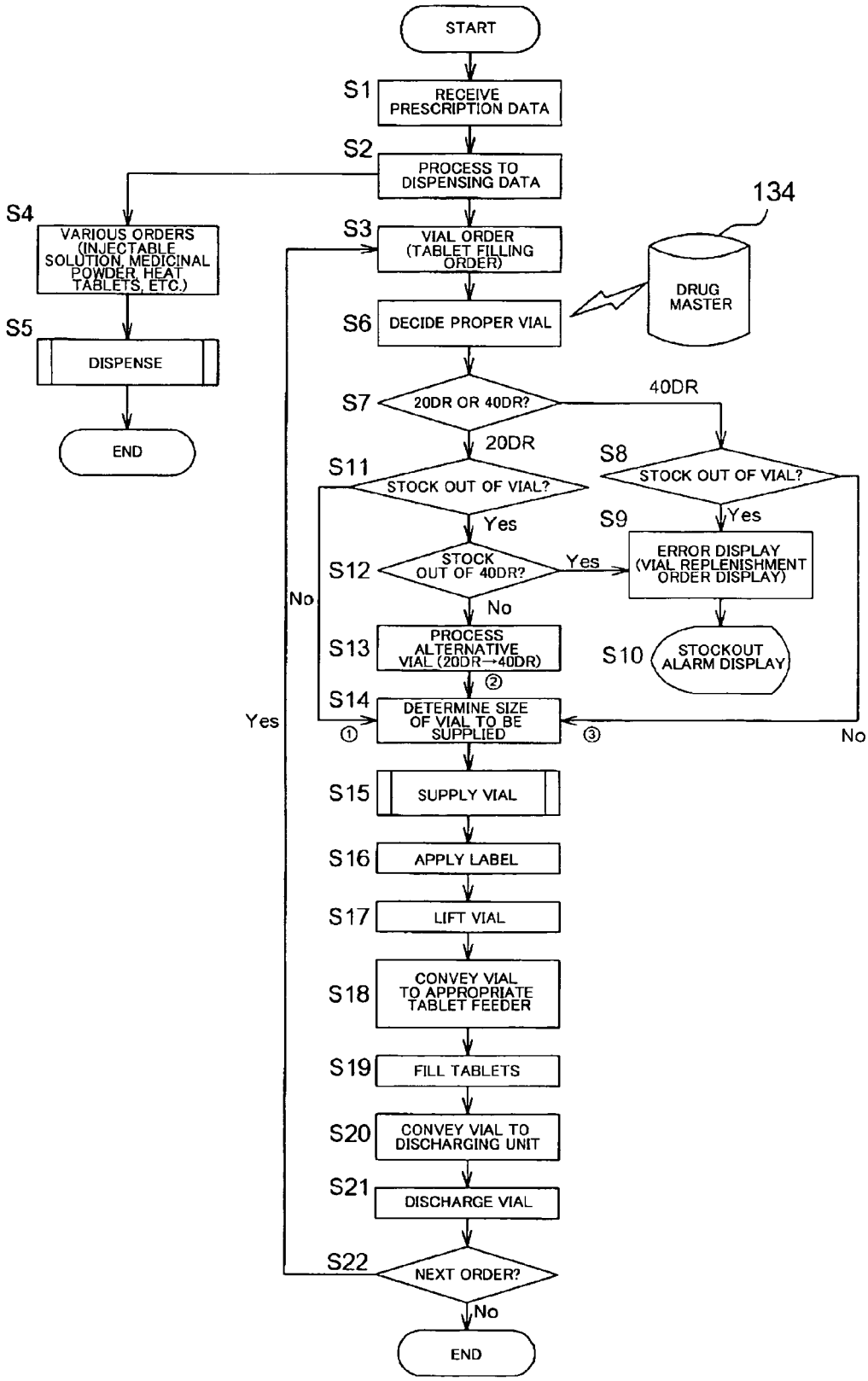
FIG. 22 is a flow chart of operations of the tablet filling instrument.

Now, operations of the tablet filling instrument 1 having the above-mentioned configuration will be described below, with reference to the flow chart in FIG. 22.

A prescription data received from the host server 133 at step S1 is processed to a dispensing data at step S2. As to tablets, a vial order is submitted to the tablet filling instrument 1 at step S3. As to injectable solution, medicinal powder, heat tablets, and the like, a dispensing order is submitted to a respective instrument at step S4 to dispense them by the respective instrument or by hand at step S5. Upon reception of the vial order, the personal computer 131 selects a proper vial 9 having volume enough to be filled with tablets based on data of maximum filling volume from a drug master 134 at step S6. The drug master 134 stores therein the maximum filling volume in a vial 9 with respect to every tablet based on data such as shape, weight, and volume of the tablet.

At step S7, the vial 9 having been selected is detected whether it is of 20 DR or 40 DR. If the selected vial 9 is of 40 DR, whether a vial 9 of 40 DR is out of stock is detected based on a detection signal of the stockout sensor 29*a* of the stocker 21 at step S8. In the case that a vial 9 of 40 DR is out of stock, a signal of error display (vial replenishment order display) is sent to the operation panel 12 at step S9. Thereby, at step S10, a stockout alarm display is indicated on the operation panel 12.

If the selected vial 9 is of 20 DR at step S7, whether a vial 9 of 20 DR is out of stock is detected based on a detection signal of the stockout sensor 29*a* of the stocker 21 at step S11. In the case that a vial 9 of 20 DR is out of stock, whether an alternative vial 9 of 40 DR larger than that of 20 DR is out is of stock is further detected at step S 12. In the case of stockout, an error display is ordered at step S9, thereby indicating a stockout alarm display on the operation panel 12 at step S10. When an alternative vial 9 of 40 DR is not out of stock at step S12, a size of the vial 9 having been selected in advance is altered from of 20 DR to of 40 DR at step S13. At step S14, when a vial 9 of 40 DR is not out of stock at step S8, the size of a vial 9 is determined to be of 40 DR as selected in advance. When a vial 9 of 20 DR is not out of stock at step S11, the size of a vial 9 is determined to be of 20 DR as selected in advance. When being altered at step S13, the size of a vial 9 is determined to be of alternative 40 DR.

In this way, the size of a vial 9 is determined at step S14, supply operation of the vial 9 starts at step S16. First, the conveyor 23 and the take-out device 24 of the stocker 21 in which vials 9 of the determined size are contained are driven. Then, one of the vials 9 in the stocker 21 is taken out by means of the paddle 25 of the take-out device 24, sliding down the chute 27, and being placed on the forks 28. Herein, a gap of the forks 28 is adjusted in accordance with the size of the vial 9, thereby allowing the vial 9 to be held by the flange 9*a* in the forks 28 with its opening upward, even if the vial 9 slides down the chute 27 with either its top or bottom in the lead.

Upon completion of the vial supply operation, a labeling operation is done so as to apply a label 33 on the vial 9 at step S16. First, the pusher 32 is driven to move the vial 9 held in the forks 27 onto the holding plate 52 of the vial lifter 4. Then, while the vial 9 is pressed on the driving roller 38 of the label printer 31 and is rotated, the label printer 31 is operated. A prescribed data is printed on a label 33 of the label tape 34 passing through the print head 36, the printed label 33 being removed from the tape 34 on approaching the vial 9 and applied on the vial 9.

Figure 7A:
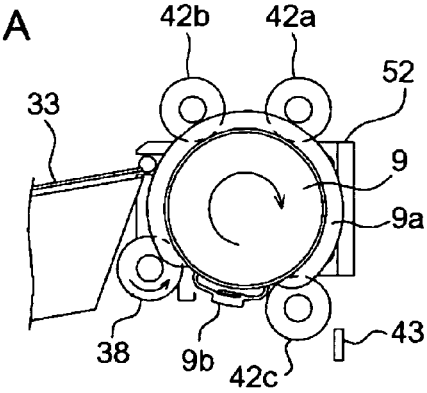
FIGS. 7A to 7D are plan views showing operations of labeling.
Figure 7B:
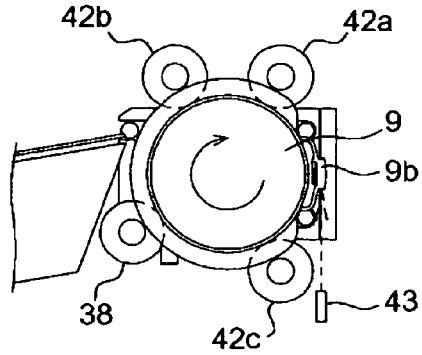
Figure 7C:
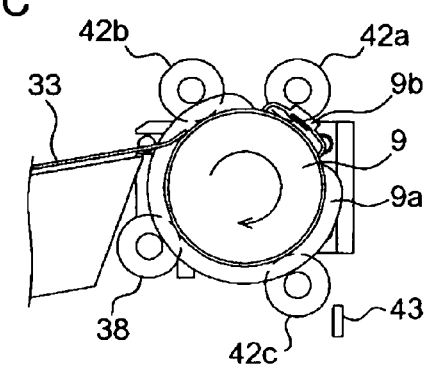
Figure 7D:
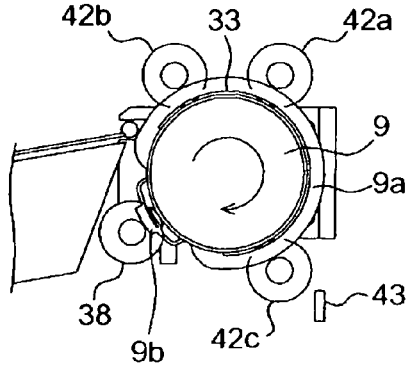

The vial 9 starts rotating as shown in FIG. 7A. The label 33 is supplied at the time when the vial 9 rotates predetermined degrees after the sensor 43 detects the protruding piece 9*b* of the vial 9 as shown in FIG. 7B, so as to be applied on a given position of the opposite side of the protruding piece 9*b* of the vial 9. Conventionally, the label 33 was randomly applied on the vial 9, so that it was necessary to turn the vial 9 by hand until the label 33 came to the front to see the label 33 of the vial 9 having discharged in the outlet 113. In the present embodiment, since the label 33 is applied on a given position, that is, on the opposite side of the protruding piece 9*b* of the vial 9, just discharging of the vial 9 so that the protruding piece 9*b* comes to the back allows to see the label 33 from the front without turning the vial 9 at the outlet 113.

Upon completion of the labeling operation, a lifting operation of the vial 9 is done at step S17. When the lifting table 51 is moved up by means of the lifting mechanism 53, the pins 55 are inserted into the holding plate 52 and the bar 54 for opening and closing pins is disengaged from the movable blocks 56. Thereby, the pins 55 are moved by the urging force of the springs 58 to hold the vial 9. The lifting table 51 is further moved up, so as to push up the holding plate 52 hung up by the bracket 61, and stops on reaching a first delivery position of the conveying unit 6. Upon holding of the vial 9 by means of the conveying unit 6 at the first delivery position, the lifting table 51 is lowered. When the lifting table 51 comes near to a waiting position down below, the bar 54 is engaged with the movable blocks 56 to which the pins 55 are attached, thereby extending the space between the pins 55 against the urging force of the springs 58, and then the lifting table 51 waits so as to receive the next vial 9. The holding plate 52 gets hung up by the bracket 61 on the way down of the lifting table 51, so that only the lifting table 51 is lowered to the waiting position. Conventionally, the lifting table is required to be equipped with a driving mechanism for holding a vial to protect the vial from dropping off during lifting and lowering of the vial, resulting in complicated control and configuration. However, in the present embodiment, the bar 54 for opening and closing pins are engaged with and disengaged from the movable blocks 56 to which the pins 55 are attached so as to open and close the pins 55 in accordance with lifting and lowering operations of the lifting table 51. Therefore, the lifting table 51 dispenses with a driving mechanism for opening and closing pins such as a motor or a solenoid. That achieves incredibly simple control and configuration.

Upon completion of the delivery operation by lifting of the vial 9, the conveying unit 6 is driven at step S18, so as to convey the vial 9 to the tablet cassette 73 containing the appropriate tablets. First, the vertical rail 92 is moved in an anteroposterior direction along the first horizontal rails 91 and the second horizontal rail 93 is moved in a vertical direction along the vertical rail 92, and whereby the arm unit 94 on the second horizontal rail 93 is brought into closer to the vial 9 on the lifting table 51, so that the arms 101 of the arm unit 94 hold the vial 9. Then, the vial 9 held by the arm unit 94 is brought into closer to the tablet cassette 73 containing the appropriate tablets. Tilting of the tilting base 99 tilts the vial 9, which opening is made located obliquely below the tablet outlet 74. The arm unit 94 is proceeded, permitting the count sensor 104 to be inserted into the sensor hole 104' of the supporting panel 71, the detection rod 109 to be inserted into the detection rod hole 109' of the panel 71, and the protruding piece 108 to be inserted into the protruding piece hole 108' of the panel 71, so as to be engaged with the engaging portion 84 of the tablet cassette 73, and permitting the engaging portion 107 of the driving shaft 106 to be inserted into the driving shaft hole 106' Of the panel 71, so as to be engaged with the engaging receptacle 83 of the tablet cassette 73.

Upon completion of conveyance of the vial 9, tablets are filled into the vial 9 at step S19. The motor 105 of the arm unit 94 is driven to rotate the rotor 77 of the tablet cassette 73 via the driving shaft 106, the worm gear 82, the intermediate gear 81, and the rotor gear 80. Thereby, tablets contained in the tablet container 76 and held in the pocket are dropped into the vial 9 one by one through the outlet 78 and the tablet outlet 74 of the supporting panel 71. The tablets passing through the tablet outlet 74 are each detected by the count sensor 104. Upon being filled with a predetermined number of tablets, the vial 9 is vertically held by returning the tilting base 99 horizontal.

Upon completion of filling of the tablets, at step S20, the conveying unit 6 is driven to convey the vial 9 having been filled with tablets to the discharging unit 7. At this time, the vial 9 is arranged to be placed above the guiding members 114 of the holding members 111 of one of the outlets 113 in which the previously discharged vial 9 is not held. Herein, whether a vial is held or not in the outlet 113 is determined by an output signal from one of vial detection sensors disposed in the guide grooves 116*a* and 116*b*. Further, a vial 9 of small size is arranged to be placed above the upper guiding members 114 and a vial 9 of large size is arranged to be placed above the lower guiding members 114. Herein, as shown in FIG. 17A, no wall exists and enough distance is left between the upper and the lower guiding members 114 and 114, so that the members such as the count sensor 104 of the arm unit 94 keep out of the upper guiding members 114 when a vial 9 is placed on the lower guiding members 114.

Upon completion of conveyance of the vial 9, at step S21, the arms 101 of the arm unit 94 are opened to place the flange 9*a* of the vial 9 onto the guiding members 114 of the discharging unit 7. Then, the door 126 is opened to allow the vial 9 to slide down the slopes 112*a* or 112*b* of a pair of the holding members 111 and to be held in the outlet 113. An operator can take out the vial 9.

Figure 17B:
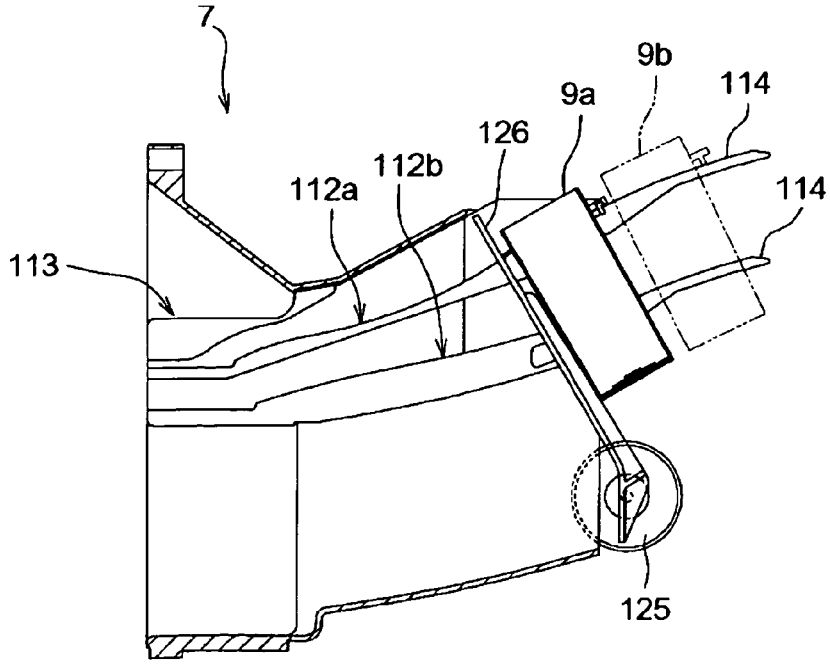

Herein, as shown in FIG. 17B, in the case that a vial 9*a* stops behind the door 126 and is not discharged because of abnormal stop of the instrument caused by an accident such as a power failure just before opening of the door 126, if a next vial 9*b* might be discharged after power fail recovery and power restoration, the two vials 9*a*, which has been stopped behind the door 126, and 9*b* might be discharged in the outlet 113. That might require confirmation of the two vials 9*a* and 9*b* or might result in potential disadvantage such as misdelivery to a patient by mixing up the vials 9*a* and 9*b*. The above-mentioned disadvantage is solved by resuming a normal to operation after the rotary solenoid 125 is certainly driven to open the door 126 so as to discharge the vial 9*a* that could be behind the door 126 upon power restoration.

Figure 18:
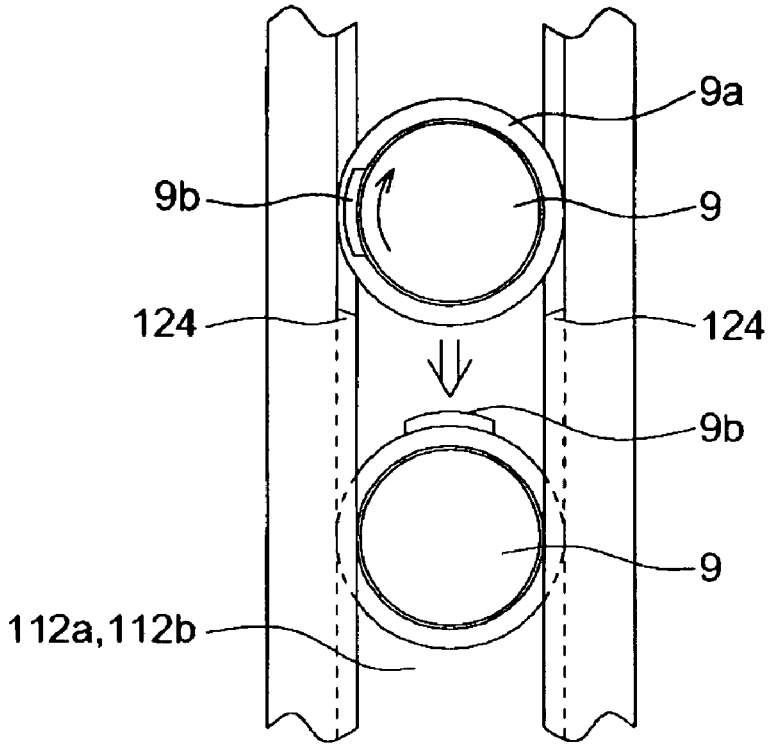
FIG. 18 is a plan view showing a vial sliding down in the discharging unit.

On the condition that the protruding piece 9*b* of the vial 9 is situated horizontally, that is, not forward or backward in a discharging direction while the vial 9 is sliding down the slopes 112*a* or 112*b*, the piece 9*b* is brought into contact with one of the protruding portions 124 of a pair of the holding members 111 as shown in FIG. 18, so as to turn to the direction of arrow. Thus, the vial 9 is discharged with the piece 9*b* backward. As a consequence, with the label 33 applied on the other side of the piece 9*b*, the label 33 of the vial 9 discharged in the outlet 113 is readily checked with eyes.

Figure 19:
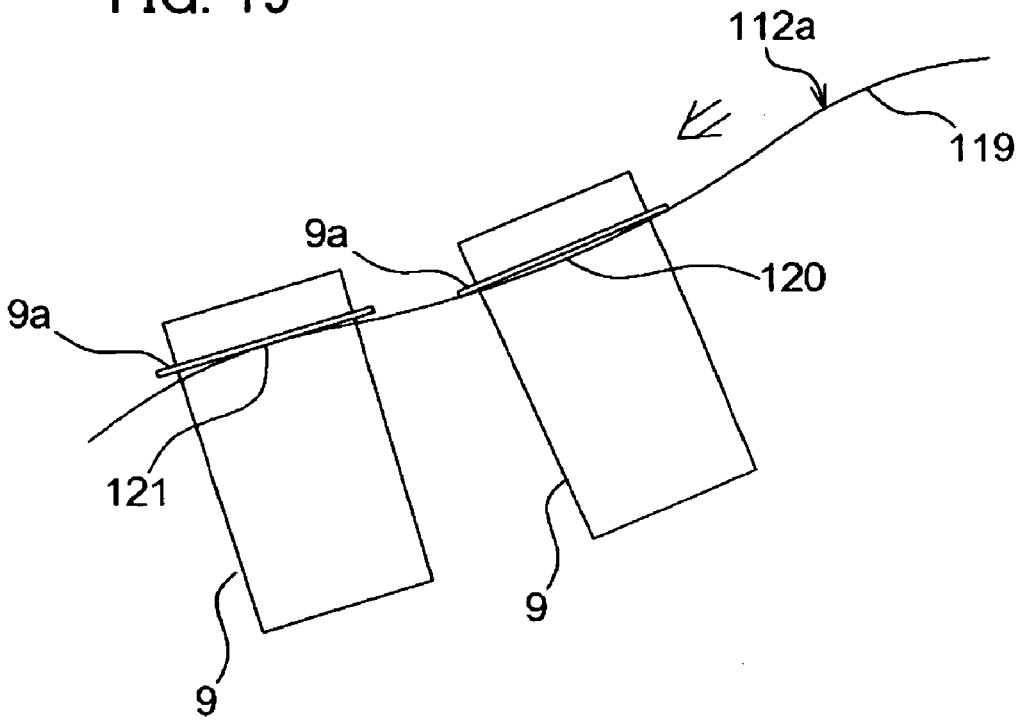
FIG. 19 is a side view showing a vial sliding down in the discharging unit.

As to the slopes 112*a* and 112*b* of a pair of the holding members 111, in each of the slopes 12*a* for example, since the convex face 119 is smoothly followed by the concave face 120, the flange 9*a* contacts with the slope 112*a* at one or two points as shown in FIG. 19. Therefore, a vial 9 smoothly and rapidly slides down with low sliding resistance.

Figure 20:
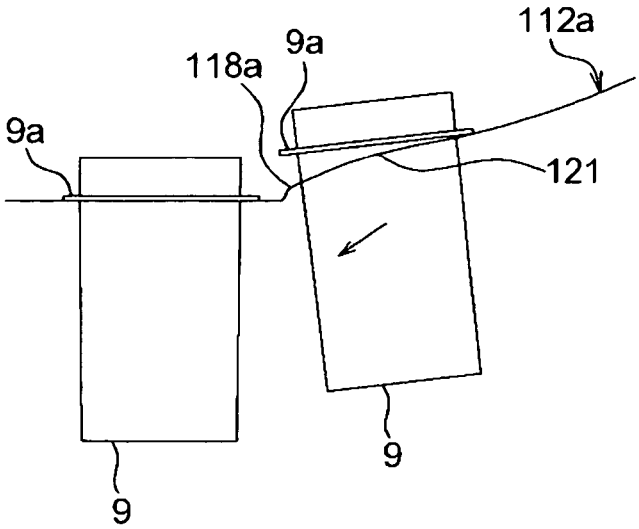
FIG. 20 is a side view showing a vial sliding down in the discharging unit.

Further, as shown in FIG. 20, when a vial 9 gets over the steps 118*a* or 118*b* adjacent to the lower ends of the slopes 112*a* or 112*b* of a pair of the holding members 111, an obliquely downward force acts, so that tablets would not spill from the vial 9 due to swing of the vial 9 in falling down onto the flat faces 117*a* or 117*b*. The vial 9 is further prevented from swinging because the downward force acts more largely at the upper slopes 112*b* each having the convex face 121 formed adjacent to the steps 118*a* and 118*b*.

The invention claimed is:

1. A tablet filling instrument having an outlet, for dispensing tablets into a vial in accordance with prescription data and discharging the vial filled with the tablets in the outlet, the vial having a flange at its outer periphery, the instrument comprising a pair of holding members each provided with a plurality of discrete slopes extending from an upper end located within the instrument to a lower end located in the outlet, the holding members being designed to receive at the upper ends of the slopes the vial filled with the tablets and to allow the vial to slide down under its own weight to the lower ends of the slopes with supporting the flange of the vial, and the discrete slopes designed to support the flange of the vial of various sizes.

2. The tablet filling instrument as defined in claim 1, the discrete slopes of the holding members each being formed by a side wall of a guide groove formed on a side of the holding member.

3. The tablet filling instrument as defined in claim 1, the discrete slopes of the holding members each having a flat face adjacent to the lower end and a step between the flat face and the lower end of the discrete slope.

4. The tablet filling instrument as defined in claim 3, the discrete slopes of the holding members each having a convex face at upstream of the step.

5. The tablet filling instrument as defined in claim 1, the discrete slopes of the holding members each comprising at least one selected from a concave face and a convex face.

6. The table filling instrument as defined in claim 1, the plurality of discrete slopes comprising first and second discrete slopes having different configurations to support the flange of the vial of various sizes.

7. A tablet filling instrument having an outlet, for dispensing tablets into a vial in accordance with prescription data and discharging the vial filled with the tablets in the outlet, the vial having a flange at its outer periphery, the instrument comprising a pair of holding members each provided with at least one slope extending from an upper end located within the instrument to a lower end located in the outlet, the holding members being designed to receive at the upper ends of the slopes the vial filled with the tablets and to allow the vial to slide down under its own weight to the lower ends of the slopes with supporting the flange of the vial, the vial having a protruding piece protruding outward from the flange, and the slopes of the holding members each having a protruding portion, so that the protruding piece of the vial is turned toward upstream of the sliding direction by contacting with one of the protruding portions of the slopes while the vial is sliding down.

8. A tablet filling instrument having an outlet, for dispensing tablets into a vial in accordance with prescription data and discharging the vial filled with the tablets in the outlet, the vial having a flange at its outer periphery, the instrument comprising a pair of holding members each provided with a plurality of discrete slopes extending from an upper end located within the instrument to a lower end located in the outlet, the holding members being designed to receive at the upper ends of the slopes the vial filled with the tablets and to allow the vial to slide down under its own weight to the lower ends of the slopes with supporting the flange of the vial, the holding members each being provided with the plurality of discrete slopes designed to support the flange of the vial of various sizes, and the slope for the vial of small size being situated above the slope for the vial of large size.

9. The tablet filling instrument as defined in claim 8, the discrete slopes having a gap between the upper ends of the slopes wider than a gap between the lower ends of the slopes.

10. The tablet filling instrument as defined in claim 8, the discrete slopes each having a guiding member extending obliquely upward at its upper end, and the guiding member having a top face continuous with the slope.

* * * * *